US006241381B1

(12) United States Patent
Noda et al.

(10) Patent No.: US 6,241,381 B1
(45) Date of Patent: Jun. 5, 2001

(54) LIQUID EJECTION APPARATUS AND LIQUID EJECTION METHOD

(75) Inventors: Hideo Noda, Amagasaki; Takaya Inoue, Takatsuki, both of (JP)

(73) Assignee: Kansai Chemical Eng. Col. Ltd., Amagasaki (JP)

( * ) Notice: Subject to any disclaimer, the term of this patent is extended or adjusted under 35 U.S.C. 154(b) by 0 days.

(21) Appl. No.: 09/556,933

(22) Filed: Apr. 21, 2000

Related U.S. Application Data

(62) Division of application No. 09/103,617, filed on Jun. 24, 1998, now abandoned.

(30) Foreign Application Priority Data

Nov. 14, 1997 (JP) ..... 9-329700

(51) Int. Cl.[7] ..... B01F 7/16

(52) U.S. Cl. ..... 366/262; 366/325.1; 366/326.1; 366/328.3

(58) Field of Search ..... 366/262–265, 366/270, 279, 292, 325.1, 328.1–330.1, 336–340, 342, 343, 349, 326.1; 261/91, 93; 416/231 A

(56) References Cited

U.S. PATENT DOCUMENTS

| | | | | |
|---|---|---|---|---|
| 8,596 | | 12/1851 | Skinner . | |
| 38,891 | | 6/1863 | Emerson . | |
| 60,097 | | 11/1866 | Waller . | |
| 469,058 | | 2/1892 | Currier . | |
| 836,717 | | 11/1906 | Trent . | |
| 873,131 | | 12/1907 | Leiser . | |
| 979,510 | | 12/1910 | Keller . | |
| 1,535,147 | * | 4/1925 | Colpitts . | |
| 2,106,529 | | 1/1938 | Keller . | |
| 2,143,652 | | 1/1939 | Gaertner . | |
| 2,800,315 | * | 7/1957 | Griesbach . | |
| 3,334,870 | * | 8/1967 | Kropp et al. . | |
| 3,576,316 | | 4/1971 | Kaelin et al. . | |
| 3,704,009 | * | 11/1972 | Kalbskopf . | |
| 3,911,065 | * | 10/1975 | Martin et al. | 261/91 |
| 3,944,119 | * | 3/1976 | Egee . | |
| 4,310,437 | * | 1/1982 | Schreiber | 261/91 |
| 4,508,455 | * | 4/1985 | Lerman et al. . | |
| 5,338,115 | * | 8/1994 | Gregg | 366/263 |

FOREIGN PATENT DOCUMENTS

| | | | | |
|---|---|---|---|---|
| 166479 | * | 1/1956 | (AU) | 261/91 |
| 248204 | | 4/1947 | (CH) . | |
| 502838 | | 2/1971 | (CH) . | |
| 185488 | | 5/1907 | (DE) . | |
| 1658067 | | 2/1970 | (DE) . | |
| 1557072 | | 4/1970 | (DE) . | |
| 1658115 | | 8/1970 | (DE) . | |
| 1941146 | | 2/1971 | (DE) . | |
| 1963614 | | 6/1971 | (DE) . | |
| 1964125 | | 6/1971 | (DE) . | |

(List continued on next page.)

OTHER PUBLICATIONS

DE 2034269 English Abstract.
CH 502838 English Abstract.
DE 1557072 English Abstract.
DE 1963614 English Abstract.

*Primary Examiner*—Charles E. Cooley
(74) *Attorney, Agent, or Firm*—Jagtiani & Associates

(57) ABSTRACT

A liquid ejection apparatus has gutter bodies secured to an agitator shaft at predetermined inclination angles or gutter bodies or tubular bodies attached to the agitator shaft so that the size of the inclination angles are adjustable. The gutter bodies or tubular bodies of the liquid ejection apparatus are revolved around the agitator shaft so that liquid is ejected from the respective upper openings of the gutter bodies or tubular bodies. This liquid is distributed onto the inner surface of a tank, and/or into a space above a liquid surface, thereby washing the inner surface of the tank, maintaining the heat transfer area, and promoting evaporation of the liquid in the tank.

39 Claims, 18 Drawing Sheets

FOREIGN PATENT DOCUMENTS

| | | | | |
|---|---|---|---|---|
| 2029908 | | 12/1971 | (DE) . | |
| 2034269 | | 1/1972 | (DE) . | |
| 1609032 | | 3/1972 | (DE) . | |
| 2418679 | | 10/1975 | (DE) . | |
| 2923375 | | 12/1979 | (DE) . | |
| 2844038 | | 4/1980 | (DE) . | |
| 0000293 | | 1/1979 | (EP) . | |
| 619136A1 | | 10/1994 | (EP) . | |
| 2009464 | | 2/1970 | (FR) . | |
| 63318 | * | 6/1985 | (FR) | 261/91 |
| 2626787 | * | 8/1989 | (FR) . | |
| 127705 | * | 6/1919 | (GB) . | |
| 749327 | * | 5/1956 | (GB) . | |
| 54-27160 | * | 9/1979 | (JP) . | |
| 60-83038 | * | 6/1985 | (JP) . | |
| 310669 | | 12/1971 | (SU) . | |
| 562303 | | 6/1977 | (SU) . | |
| 914077 | | 2/1980 | (SU) . | |
| 997774 | | 2/1983 | (SU) . | |
| 1042786 | * | 9/1983 | (SU) . | |
| 1428714 | * | 10/1988 | (SU) . | |
| 1542601 | | 2/1990 | (SU) . | |

* cited by examiner

LIQUID EJECTION APPARATUS AND LIQUID EJECTION METHOD

CROSS-REFERENCE TO RELATED APPLICATION

The present application claims the priority of U.S. Pat. application Ser. No. 09/103,617, entitled "Liquid Ejection Apparatus and Liquid Ejection Method" filed Jun. 24, 1998, now abandoned, the entire disclosure and contents of which is hereby incorporated by reference.

BACKGROUND OF THE INVENTION

1. Field of the Invention

The present invention relates to a liquid ejection apparatus and a liquid ejection method using the liquid ejection apparatus. More particularly, the invention relates to a liquid ejection apparatus and a liquid ejection method for ejecting liquid inside a tank into a space above the liquid surface, or towards a peripheral wall.

2. Description of the Related Art

In fermentation and culturing, the fermenting liquids and culturing liquids are very prone to foaming. Due to agitation during the process, there is a considerable amount of foaming so that operability is often impaired. In order to inhibit such foaming, and to disperse the temporarily created foam, anti-foaming agents such as silicone are added. The addition of such anti-foaming agents however not only involves significant cost, but also poses a risk adversely affecting the fermentation and culturing processes, because these anti-foaming agents are in themselves foreign substances to the liquids. In addition, the anti-foaming agents are mixed with the product as impurities so that the quality of the product is degraded. Moreover additional time is required to remove them from the product. Furthermore they are mixed in the waste liquid and thus impede the treatment of the waste liquid. Hence the addition of anti-foaming agents is an undesirable means, which should be avoided as much as possible.

A problem is that the inner peripheral surface of the wall of the agitating tank becomes contaminated by micro-organisms or solid raw materials or products being deposited thereon. This often causes a decrease in reaction yield or a reduction in heat transfer coefficient of the agitating tank peripheral wall. In this case, it is practically impossible to wash the inner peripheral surface of the wall of the agitating tank to remove the extraneous matter from the inner peripheral surface of the agitating tank without stopping the operation in the agitating tank.

Yet another problem is that when apparatus such as jackets, and coiled pipes and multi-tube heating units are respectively provided on the outer peripheral surface of the peripheral wall of the agitating tank and inside the agitating tank, as apparatus for heating or cooling the liquid inside the agitating tank, there is often the situation where the liquid inside the agitating tank decreases due for example to evaporation so that with time, the liquid level inside the agitating tank drops, and the heat transfer area of the heating or cooling apparatus cannot be effectively utilized.

In order to increase and hence recover the reduced heat transfer area, there is a means involving supplying fresh liquid to the tank so that the liquid surface is raised; and a method involving circulating the remaining liquid inside the tank by means of a pump provided outside of the tank to distribute the liquid onto the inner peripheral surface of the tank wall. The former wherein fresh liquid is supplied to the tank, has the defect that there is an abrupt change in the composition of the liquid inside the tank, requiring a change in operational conditions, and also the quality of the product changes. Moreover, the latter has the defect that it requires a pump and piping for circulating the remaining liquid, so that after operation, residual liquid remains in the tank as well as inside the piping.

Accordingly, means which can be put into practice to solve the defect that the heat transfer area cannot be effectively used have yet to be found.

When desired to evaporate the liquid inside the agitating tank, there is a method involving immersing a heating device in the liquid and/or mounting a heating device on the outside of the agitating tank peripheral wall, to thereby apply heat to cause evaporation from the liquid surface either while agitating or not agitating the liquid. With this method there is the defect that the heat in the space above the liquid surface which is heated by the heating device cannot be effectively utilized, and that the heating of the liquid is limited to the contact area of the heating device, so that the heat from the heating device cannot be effectively utilized and the rate of evaporation of the liquid is slow.

The present inventors have overcome the defects with the conventional agitation such as contamination of the surface of the inner peripheral surface of the peripheral wall of the agitating tank and the surface of the heating or cooling apparatus and a reduction in the heat transfer area by using only mechanical agitation. Hence, with good efficiency, the inner peripheral surface of the peripheral wall of the agitating tank and the surface of the heating or cooling apparatus are washed, thereby preventing the reduction in the heat transfer area of the inner peripheral surface of the peripheral wall of the agitating tank and of the heating or cooling apparatus. Moreover, the accumulated results of a thorough study into agitating blades and agitating methods which can achieve mixing of liquids of different specific gravities and suspensions with good efficiency, have led to an invention related to agitating blades and agitating methods (EP 0619136A).

The agitating blades of this prior invention are agitating blades wherein a liquid transporting body such as one or a plurality of tubular bodies, gutter bodies, and plates, is attached preferably at an incline to an attachment device mounted on an agitator shaft, the liquid transporting body being open at both ends with an upper opening and lower opening.

The present inventors, from the accumulated results of continuous investigations to solve the former problems discovered the following problems in the invention related to the beforementioned patent application. That is to say, in the abovementioned prior application, the liquid transporting body is preferably secured at an incline. Since the inclination angle is fixed and is not changed, then in changing the purpose of use and the conditions of the agitating blades, the agitating blades must be stopped and removed from the tank to change the inclination angle.

Furthermore, with the tubular body constituting the liquid transporting body, normally it is common for this to be in contact with liquids with strong corrosive characteristics. Hence in order to have complete corrosion resistance, the surface is coated or lined with a substance having a high corrosion resistance such as a synthetic resin like polytetrafluoroethylene, or glass or a ceramic or the like. However, while with such a coating or lining, the technology has improved remarkably, there is still the danger of pinholes. Consequently due to these pinholes, it is difficult to ensure the reliability of the corrosion resistance of the coated or lined tubular body.

In order to increase the reliability of the corrosion resistance of the tubular body, then prior to use of the tubular body, the presence of pinholes in the coating layer or the lining layer of the tubular body (these layers are in general referred to simply as a lining layers) is preferably checked for not only on the outer face of the pipe but also on the inner face. However, checking for the presence of pinholes in the inner face of the pipe is extremely difficult. Moreover, even if pinholes are found, it is difficult to repair these pinholes.

Therefore it is preferable to use a gutter body as the liquid transporting body, since with a gutter body, it is easy to check for the presence of pinholes in the lining layer, and hence to repair the pinholes.

In the specification of the beforementioned prior patent application, in the case where a gutter body is used as the liquid transporting body, the principle of raising the liquid with the gutter body and discharging this from the upper opening is disclosed. However there is no disclosure at all regarding the mounting face and the mounting direction.

With regards to use, in the case where the liquid discharged from the upper opening of the gutter body is used for example for washing the inner peripheral surface of the tank wall by distributing this onto the inner peripheral surface of the tank wall, or for maintaining the heat transfer area and/or washing the heat transfer surface by distributing this onto the heat transfer surface, or for evaporation by distributing this into the space above the liquid surface, then needless to say it is preferable to have a large distance and quantity (hereunder referred to as the ejection distance and ejection quantity) for the liquid ejected from the upper opening of the liquid transporting body.

SUMMARY OF THE INVENTION

It is an object of the present invention to take into consideration the above situation with conventional liquid ejection apparatus and provide an improved liquid ejection apparatus and improved liquid ejection method using the liquid ejection apparatus.

The present inventors selected the size of the inclination angle of the liquid transporting body in order to increase the ejection distance and ejection quantity of the ejected liquid. Furthermore, in the case where the liquid transporting body was a gutter body, it was realized that the mounting face and mounting direction of the gutter body must be selected for the ejection distance and ejection quantity of the liquid from the upper opening of the gutter body. The present invention has been reached based on this knowledge.

According to a first aspect of the invention there is provided a liquid ejection apparatus wherein at least one gutter body serving as a liquid transporting device and having a lower opening and an upper opening at respective lower and upper end portions thereof is secured to an agitator shaft by means of an attachment device, the gutter body having an inclination angle greater than 0° and up to 90°, and the gutter body is revolved around the agitator shaft axis with a concavity facing the agitator shaft or the revolution direction, and the lower opening of the gutter body immersed beneath a liquid surface, and the upper opening of the gutter body exposed from the liquid surface, so that the liquid at the immersed portion of the gutter body passes within the gutter body and is ejected from the upper opening thereof.

According to a second aspect of the invention there is provided a liquid ejection apparatus wherein at least one gutter body serving as a liquid transporting device and having a lower opening and an upper opening at respective lower and upper end portions thereof is mounted on an agitator shaft by means of an attachment device, the gutter body having an inclination angle which is adjustable to be greater than 0° and up to 90°, and the gutter body is revolved around the agitator shaft with a concavity facing the agitator shaft or the revolution direction, and the lower opening of the gutter body immersed beneath a liquid surface, and the upper opening of the gutter body exposed from the liquid surface, so that the liquid at the immersed portion of the gutter body passes within the gutter body and is ejected from the upper opening thereof.

According to a third aspect of the invention there is provided a liquid ejection apparatus wherein at least one tubular body serving as a liquid transporting body and having a lower opening and an upper opening at respective lower and upper end portions thereof is mounted on an agitator shaft by means of an attachment device, the tubular body having an inclination angle which is adjustable to be greater than 0° and up to 90°, and the tubular body is revolved around the agitator shaft with the lower opening of the tubular body immersed beneath a liquid surface, and the upper opening of the tubular body exposed from the liquid surface, so that the liquid at the immersed portion of the tubular body passes within the tubular body and is ejected from the upper opening thereof.

According to a fourth aspect of the invention there is provided a method of ejecting a liquid involving revolving the liquid transporting body of the liquid ejection apparatus according to the abovementioned respective first, second and third aspects of the invention, around the agitator shaft with the lower opening immersed beneath the liquid surface, and the upper opening exposed from the liquid surface, so that the liquid at the immersed portion of the liquid transporting device passes within the liquid transporting device and is ejected from the upper opening thereof.

The liquid ejected from the upper opening of the liquid transporting device in the fourth aspect of the invention is used for example for washing the inner peripheral surface of a container wall, for maintaining the heat transfer area and/or washing the heat transfer surface, or for evaporating the liquid in the space above the liquid surface.

With the present invention while having no particular limit, the terms upper and lower are respectively defined as a position near to the bottom of the liquid and a position far from the bottom of the liquid.

The attachment device is for mounting one or more liquid transporting bodies on the agitator shaft. The attachment device may be a rod, a rectangular or square bar, a shaped steel body, a pierced plate body (referred to hereunder as a perforated plate), or a non-perforated plate. With the non-perforated plate and perforated plate, these are preferably attached to the agitator shaft such that when turned within a liquid, the fluid resistance is as small as possible. When the non-perforated plate is used vertically in the liquid (perpendicular to the rotation plane of the liquid transporting body) the width is preferably narrow.

The rods, square bars, shaped steel bodies, perforated plates and non-perforated plates are positioned approximately on a radius or diameter in the revolution plane. The number of rods, square bars, shaped steel bodies, perforated plates and non-perforated plates may be one or more. When a plurality are used, then normally each member is positioned either on the same revolution plane or on planes differing from each other.

One or a plurality of liquid transporting bodies may be attached to one attachment device. The number of liquid transporting bodies attached to one attachment device is appropriately selected depending for example on the viscosity of liquid, the type of liquid transporting body, the thickness of the liquid transporting body, the diameter of the container itself, the angle between the agitator shaft and the liquid transporting body, and the use of the liquid ejected from the upper opening of the liquid transporting body (referred to hereunder as the ejected liquid). So are when the attachment position of a liquid transporting body is decided in the case when one liquid transporting body is attached to one attachment device, or when the spacing and the attachment position of the neighbouring liquid transporting bodies are decided in the case where a plurality of the liquid transporting bodies are attached to one attachment device.

The gutter body serving as the liquid transporting body is preferably made from a metal such as steel or stainless steel with the surface coated or lined with a substance having a high corrosion resistance such as a synthetic resin like polytetrafluoroethylene, or glass or a ceramic or the like. However this may be made from a corrosion resistant material such as highly corrosion resistant plastics or metal, or glass or ceramics.

The gutter body is a long body having an opening in a longitudinal direction. The shape of the central transverse section, and the respective shapes of the upper end opening and lower end opening of the gutter body have no particular limitation. It is also possible to make these a left/right symmetrical or a left/right non-symmetrical shape (referred to hereunder as symmetrical shape and non-symmetrical shape). However in practice the former is preferable.

As a representative example of the symmetrical shape, the following can be considered; a circumference with part of an arc missing (referred to hereunder as a cut out circumference), a semi-circle, a semi-elliptical circumference, a half oval, a U-shape, a V-shape, polygon shapes such as; a trapezoid, a square, a rectangle, a modified pentagon shape wherein a right octagon shape has been divided in two by a straight line connecting a first point and a fifth point thereof, and a modified hexagon shape where a right octagon shape has been divided in two by a straight line connecting the central points of respective first and fifth sides thereof, as well as shapes wherein the head angles of the polygon shapes are rounded and/or the sides are bent outwards with a small curvature (referred to hereunder as substantially polygon shapes) and one side is removed.

As a representative example of the non-symmetrical shape, there are for example shapes where one of the peripheries or the sides at the edge (referred to hereunder as the opening edge) corresponding to the two peripheral edges of the opening of the beforementioned symmetrical shapes is extended (these symmetrical shapes and non-symmetrical shapes are referred to hereunder as open shapes).

The gutter body may be made of an equal sided V-shaped steel body, an H-shaped steel body, or as a C-shaped steel body wherein the transverse section is a quadrilateral of square or rectangular shape or is circular. The C-shaped steel body is preferable. The equal sided V-shaped steel body gives a gutter body having a right angled V-shape opening. The H-shaped steel body gives a gutter body having a square or rectangular shaped opening with respective opposite sides missing. The C-shaped steel body wherein the transverse section shape is a quadrilateral gives a gutter body having a quadrilateral shape opening with one portion of one side missing, while the C-shaped steel body wherein the transverse section shape is circular gives a gutter body having a cut-out circumference opening.

In coating or lining the gutter body which in itself is known, prior to coating or-lining, the edges of the openings are preferably rounded, or enlarged into a column shape.

The shape and size of the respective upper and lower openings of the gutter body can be the same as each other or different from each other.

Preferably the area of the upper opening is smaller than the area of the lower opening. The respective opening areas of the upper opening and the lower opening of the gutter body are defined as the areas which acquire the through flow of liquid along the concavity of the gutter body. With the respective opening areas of the upper opening and lower opening of the gutter body, in the case where the shape of the upper opening and lower opening are an open shape with left-right symmetry, then this is the area enclosed by the shape and a straight line connecting the opposite opening edges. In the case where the transverse section shape of the upper opening and lower opening is a non-symmetrical open shape, then this is the area enclosed by the shape and a straight line connecting the extended portion edge and the other opening edge, or the area enclosed by the shape and a straight line connecting the opposite opening edges excluding the extended portion.

There is no particular restriction on the shape of the side face of the gutter body (referred to hereunder as the side shape), however normally this is a straight line, a curve which is bent at a small curvature so as to protrude upward or downward, or an S-shape wherein the upper end and/or the lower end of a straight line or the beforementioned curve are further extended in the transverse direction. For the curve, a parabola is preferable. Among other things, a straight line is preferable since this simplifies formation of the gutter body. Moreover, a curve which is bent so as to protrude downwards is preferable since this enables an increase in the discharge distance and/or the discharge amount. A parabola which is bent so as to protrude downwards is particularly desirable.

There is no particular restriction on the shape as seen from the front (referred to hereunder as the front shape), however normally this is a straight line, a curve which is bent at a small curvature in the transverse direction (a direction parallel with the rotation plane of the gutter body; defined similarly hereunder), or an S-shape wherein the upper end and/or the lower end of a straight line or the beforementioned curve are further extended in the transverse direction. However, a straight line is preferable.

As with the beforementioned side shape and front shape, there is no particular restriction on the shape as seen from above or beneath (referred to hereunder as the plan shape). This may be a straight line, a curve which is bent at a small curvature towards the direction of revolution of the gutter body or the opposite direction, or an S-shape wherein the upper end and/or the lower end of a straight line or the beforementioned curve are further extended in the transverse direction. However among other things a straight line is preferable.

There is no particular limit to the length of the gutter body. The lengths of a plurality of gutter bodies attached to the attachment device can be the same as each other, or may be different from each other.

The gutter body may be twisted sufficiently to obtain raising of the liquid.

The gutter body is attached to the agitator shaft with the concavity facing the agitator shaft or the revolution direction. In this case, the eccentric or deviation angle defined hereinunder is appropriately selected depending for example on the shape of the gutter body itself and the opening shape, the opening area ratio between the upper and the lower openings, and the use of the ejected liquid. The eccentric or deviation angle means angle between the center line of the gutter body (being the line perpendicular to and equally dividing a line connecting the symmetrical shape opposite edges of the opening; defined similarly hereunder) and a diameter of the revolution plane of the gutter body which passes through the center point of the gutter body (the intersection point of the before-mentioned center line of the gutter body and the gutter body: defined similarly hereunder).

In order to eject the liquid from the upper opening of the gutter body as a spray, as minute droplets, or as a fine flow, then the whole of the upper opening of the gutter body can be covered with a perforated plate drilled with a plurality of holes, or with a mesh. This is also preferable. With the perforated plate, the plurality of holes may be pierced regularly or irregularly. There is no particular restriction on the shape and number of holes. As a representative example of the shape of the holes, these may be circular, elliptical, square, or rectangular.

A deflector plate may be provided spaced apart from the upper opening of the gutter body, to thereby abruptly change the direction of the liquid ejected therefrom. Moreover, with the gutter body, the upper opening may be closed off by a plate such that a gap is formed along the inner peripheral surface of the gutter body.

The longitudinal opening of the gutter body may be covered with a non-permeable or permeable cover which is removable.

Moreover, the gutter body may be free to turn around the longitudinal axis thereof. In this case, the eccentric or deviation angle is appropriately selected depending for example on the shape of the opening and the size of the inclination angle of the gutter body, the viscosity of the liquid in the container, and the revolution speed of the gutter body. In the case when the gutter body is free to turn around longitudinal axis thereof as mentioned above, the gutter body may be rotatably mounted on the attachment device. In this case the gutter body may also be secured after being turned to an optional eccentric or deviation angle. Moreover, this can be turned automatically depending on the revolution speed of the gutter body. In this case, the gutter body is mounted on the agitator shaft so as to be freely rotatable.

When attaching the gutter body to the attachment device, the arrangement must be such that the attachment device does not obstruct the rising of the liquid within the concavity of the gutter body.

The gutter body is secured to the attachment device at an inclination angle of a predetermined size. Furthermore, this may be mounted such that the size of the inclination angle (the angle between the longitudinal axis of the gutter body and the rotation plane of the gutter body: defined similarly hereunder) can be optionally adjusted. The latter arrangement however is preferable. Here the longitudinal axis of the gutter body is defined as the line connecting the center points of the gutter body at the respective upper and lower openings.

The inclination angle is made greater than 0° and up to 90°. The lower opening may be closer to the agitator shaft than the upper opening, or the distances from the agitator shaft to the lower opening and to the upper opening may be made equal to each other. In practice however, the former is desirable. In the case of the latter, then the lower opening of the gutter body is preferably closed off. In this case also, the liquid at the immersed portion of the gutter body is raised inside the gutter body. The size of the inclination angle is appropriately selected depending for example on the type of liquid, the rotational speed of the liquid transporting body, the desired discharge distance and discharge amount for the ejected liquid, and the use of the ejected liquid. Normally 5° to 85° is ideal.

The size of the inclination angle of a gutter body is appropriately selected depending for example on the shape of the gutter body itself and the opening shape, the opening area ratio between the upper and the lower openings, and the use of the ejected liquid.

In order to mount the gutter body on the agitator shaft so that the size of the inclination angle can be adjusted, then for example the lower end portion of the gutter body may be hinged so as to fit over the agitator shaft, and the upper end mounted so that the upper opening of the gutter body is moveable along the radius of the rotation plane by means of a vertical traveller device or a horizontal traveller device. The device for moving the upper opening of the gutter pipe involving a vertical traveller device, and the device involving a horizontal traveller device are referred to hereunder respectively as a vertical system and a horizontal system.

Furthermore, the gutter body may be bendable and/or able to be telescoped. To make the gutter body bendable, then for example the gutter body may be made from a flexible material, or the gutter body may be divided into a plurality of sections, and these sections connected by joint members (a gutter body section is referred to hereunder as a gutter segment). In order to enable telescoping of the gutter body, then for example a plurality of gutter segment may be connected together so as to be slidable relative to each other.

In the case where a plurality of the gutter bodies are secured to an attachment device, then these may be arranged independent of each other, or may be formed integral with each other. For the latter, then for example the opposite inclined sides of a trapezoidal plate may be bent in opposite directions to each other to thereby give gutter bodies formed by the bent portions. In this case, the unbent flat portion may be made the attachment device, or a separate attachment device may be provided for the trapezoidal plate. The unbent flat portion acts as an agitator blade. With this gutter body, the respective shapes of the upper opening and lower opening are non-symmetrical. Moreover, by forming openings in the flat portion constituting the attachment device, then fluid resistance of the attachment device can be reduced. This is also desirable.

When the gutter body is attached so that the lower opening thereof is closer to the agitator shaft than the upper opening thereof, as mentioned hereinunder referring to FIG. 11, the lower opening 11 of the gutter body 1 may be located on or off a plane involving the agitator shaft 3 and the upper opening 12. In the off case, the gutter body 1 can be managed to revolve so that the lower opening 11 is leading or following, although the former is preferable. When a plurality of gutter bodies are attached at an incline, they may be arranged so that the lower end portions cross over each other in the vicinity of the agitator shaft.

In the case where the corrosiveness of the liquid inside the tank is minimal, then instead of a gutter body mounted such that the size of the inclination angle is optionally adjustable, a tubular body may be similarly mounted.

This tubular body, as with the beforementioned gutter body, is preferably coated or lined. However, a coating or lining is not always necessary.

There is no particular restriction to the shape of the transverse section in case of the tubular body (the section perpendicular to the longitudinal axis). However, shapes such as circular types including circles, ellipses, or ovals, polygon types including squares, rectangles, pentagons, and hexagons, and shapes wherein the head angles of polygons are rounded and/or the sides are bent outwards with a small curvature (referred to hereunder as substantially polygon shaped) are preferable.

The upper opening and lower opening of the tubular body may constitute respective bases of the tubular body. Furthermore, the tubular body may be formed by covering the bases with base plates and drilling holes in the ends of the tubular body.

The attachment device with the liquid transporting body attached thereto may be secured to the agitator shaft, or slidably mounted thereon, no matter which the transporting body may be, gutter body or tubular body. The lower opening of the liquid transporting body is immersed beneath the liquid surface, while the upper opening is exposed from the liquid surface. By rotating the agitator shaft and hence revolving the liquid transporting body, the liquid at the immersed portion of the liquid transporting body is raised inside the liquid transporting body due to the centrifugal force, and is ejected from the upper opening. Together with this, the liquid is agitated by the portion of the liquid transporting body beneath the liquid surface.

With the liquid ejection apparatus of the present invention, the liquid transporting body is secured to the agitator shaft, or is slidably mounted thereon by means of the attachment device. There is no particular restriction to the securing means and for example an insertion, threading, welding or bonding or the like may be used.

In the case where the attachment device is secured, then one attachment device may be mounted on the agitator shaft, or a plurality of attachment devices may be mounted thereon along the longitudinal axis. In the case of the latter, the liquid will be agitated by the liquid transporting bodies which are immersed beneath the liquid surface, and hence this is preferable. Furthermore, in the case of the latter, the lower opening of an upper stage liquid transporting body and the upper opening of a lower stage liquid transporting body are preferably made to overlap each other in the longitudinal axis direction of the agitator shaft.

In the case of mounting so as to be slidable, this may be achieved for example by providing on the surface of the agitator shaft along the longitudinal axis thereof a groove or protuberance or spline, and providing on the attachment device a protuberance or groove or spline which can slidably engage with the groove or protuberance or spline on the agitator shaft.

Furthermore, the attachment device slidably mounted on the agitator shaft may be moved automatically or manually. For example, a floating element may be provided on the attachment device so that this can be floated on the liquid surface and thus moved automatically corresponding to the up and down movement of the liquid level inside the tank. Moreover, this may be moved up and down by remote operation from outside the tank. Furthermore, this may be stopped at a predetermined position. In addition, this may be moved up and down by hand, by suspending the attachment device from a connecting wire outside of the tank, and tensioning and slackening the wire outside of the tank.

The floating element may also serve a dual role as an attachment device. The floating element is preferably of a shape and construction which will result in minimum fluid resistance during agitation.

With the liquid ejection apparatus of the present invention, the immersed portion of the liquid transporting body acts as an agitating blade. However other agitating blades such as turbine blades, propellers, pitched flat vanes, flat vane disc turbines, flat vanes, curved vanes, or Pfaudler-type impellers and Brumagin-type impellers may be combined together with the liquid transporting body.

Moreover, the attachment device itself may act an agitating blade.

There is no particular restriction to the size of the liquid ejection apparatus of the present invention. For example this may be an optional size such as a laboratory type small scale apparatus used for example inside a flask, or a large scale apparatus used for example inside a large size tank at a manufacturing plant of a factory.

The liquid agitating apparatus of the present invention for installing inside a flask is preferably one where the inclination angle is adjustable by the vertical system.

The ejected liquid ejected from the upper opening of the liquid transporting body may be employed for the following various uses. For example:

(a) For distributing liquid onto the inner peripheral surface of a tank wall to wash the inner peripheral surface;

(b) In the situation where the liquid level inside the tank drops, then in the case of a tank provided with a jacket on the outer surface of the tank wall, for distributing liquid onto the inner surface of the tank wall which serves as a heat transfer surface, or with a tank provided with coiled piping or a multi-tube unit inside the tank, for distributing liquid onto the surface of the coiled piping or of the multi-tube unit which serves as a heat transfer surface, to thereby maintain the heat transfer area, and/or wash the surface;

(c) For distributing liquid into the space above the liquid surface to evaporate the liquid; and (d) For other uses.

In the case where the ejected liquid is used for evaporating liquid in the space above the liquid surface, then one or a plurality of liquid transporting bodies are attached to one attachment device in the radial direction of the revolution plane with the inclination angle selected corresponding to the revolution speed of the liquid transporting body (peripheral speed in the plane of revolution), so that the ejected liquid is rapidly discharged. Normally this is from 15° to 85°.

Furthermore, in order to evenly distribute the ejected liquid onto the liquid surface then preferably a plurality of liquid transporting bodies are attached to one attachment device.

In the case where the ejected liquid is employed to wash the inner peripheral surface of the tank wall and/or maintain the heat transfer area of the tank wall which serves as a heat transfer surface, then at least one liquid transporting body need be provided on one attachment device at the tip end thereof, with the upper opening of the liquid transporting body close to the inner peripheral surface and within the ejection distance of the ejected liquid therefrom.

Furthermore, in the case where this is employed to maintain the heat transfer area and or wash the heat transfer surface of a heating or cooling apparatus such as coiled tubes or a multi-tube unit provided inside the tank, then only one liquid transporting body need be provided on one attachment device with the upper opening of the liquid transporting body close to the heat transfer surface and within the ejection distance of the ejected liquid therefrom.

With the liquid ejection method of the present invention, the revolution speed of the liquid transporting body is appropriately selected depending for example on the liquid type, the shape and thickness of the liquid transporting body, and the use of the ejected liquid.

Other objects and aspects of the present invention will become apparent from the following description of embodiments, given in conjunction with the appending drawings.

BRIEF DESCRIPTION OF THE DRAWINGS

In FIG. 1A, the agitator shaft is shown as a cross-section end face;

In FIG. 12B, the agitator shaft as shown as a cross-sectional end face;

DESCRIPTION OF THE PREFERRED EMBODIMENTS

Figure 1A:
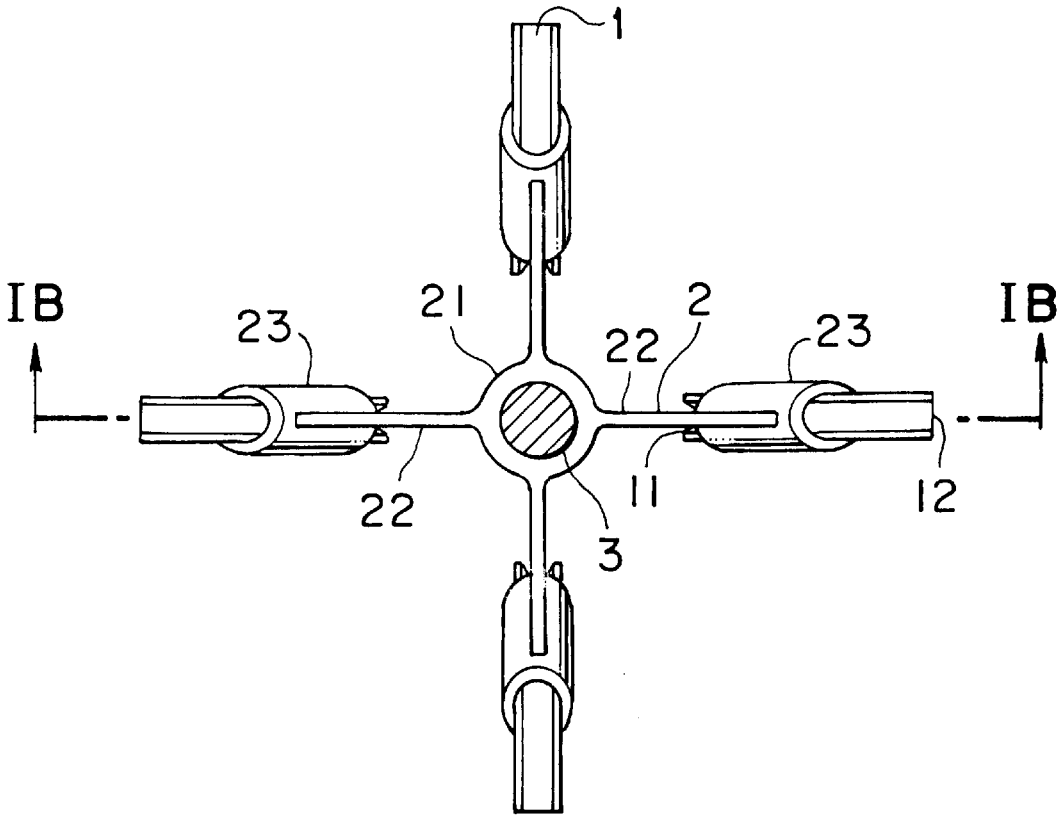
FIG. 1A shows a plan view of a liquid ejection apparatus with respective gutter bodies fixedly attached to an agitator shaft by means of an attachment device.

The present invention will now be described more specifically by means of embodiments shown in the drawings. However the invention is not limited to these embodiments.

The drawings are typical ones for illustrating the theory of the present invention, and the relative size etc. is not shown accurately.

Figure 1B:
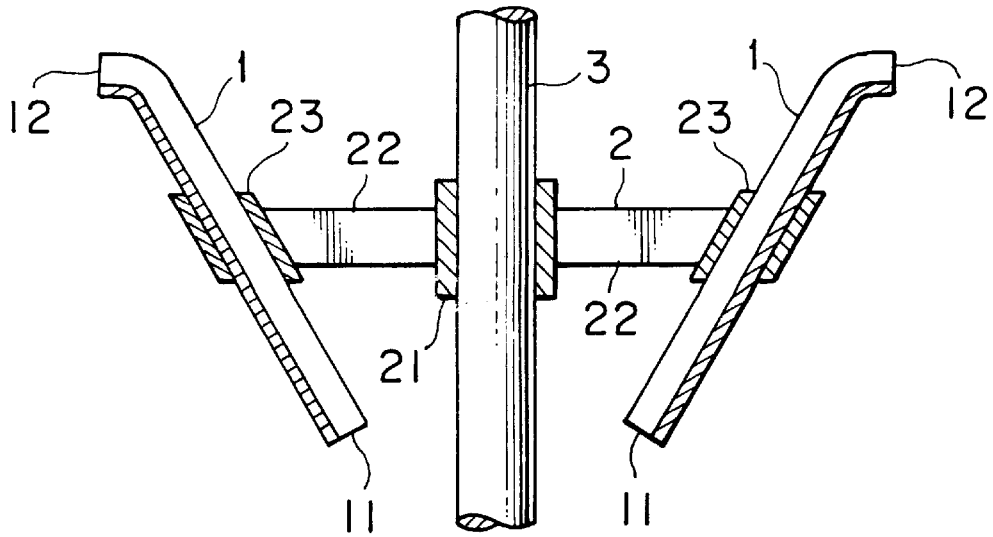
FIG. 1B is a cross-sectional view on section IB—IB shown in FIG. 1A.

In FIG. 1A and FIG. 1B, gutter bodies 1 are fixedly mounted to an agitator shaft 3 by means of an attachment device 2.

The cross-sectional shapes of the gutter bodies 1 at a central portion, upper opening and lower opening are semicircular, corresponding to the shape of a cylinder which has been longitudinally sectioned along a face parallel with a face including the base face (cutting in the longitudinal axis direction parallel with a face including the base face is referred to hereunder as half cutting), and the upper part is extended substantially horizontally.

The attachment device 2 comprises plates 22 secured to a central ring 21 and radiating out at a central angle of 90°. Retainers 23 for holding the gutter bodies 1 are provided on the tips thereof. The agitator shaft 3 is passed through the central ring 21, and the attachment device 2 is then fixedly secured to the agitator shaft 3. The plates 22 are long rectangular flat plates with an inclined tip. The surfaces thereof are aligned parallel with the axial direction of the agitator shaft. The retainers 23 are tubes having inner radii equal to the outer radii of the gutter bodies 1.

The gutter bodies 1 are passed through and secured to the retainers 23 of the attachment device 2, with lower openings 11 thereof arranged closer to the agitator shaft 3 than upper openings 12. The concavities or the longitudinal openings of the gutter bodies are arranged facing inwards towards the agitator shaft, and such that the retainers 23 of the attachment device 2 do not obstruct the liquid rising in the concavities. The inclination angles of the gutter bodies 1 are made approximately 60°.

With this liquid ejection apparatus, the lower openings 11 of the gutter bodies 1 are immersed beneath the liquid surface, while the upper openings 12 are exposed from the liquid surface. By rotating the agitator shaft 3 and hence revolving the gutter bodies 1, the liquid is subjected to a centrifugal force, so that the liquid at the immersed portion of the gutter bodies 1 rises inside the concavities towards the upper openings 12 of the gutter bodies 1, and is ejected from the upper openings 12. Together with this, the liquid is agitated by the portions of the gutter bodies 1 beneath the liquid surface.

Figure 2A:
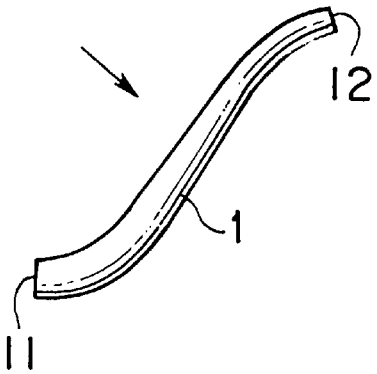
FIG. 2A is a side view of one embodiment of S-form gutter body.
Figure 2B:
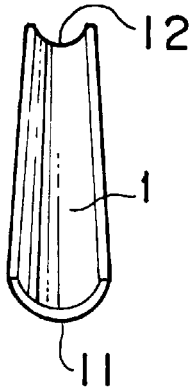
FIG. 2B is a front view seen from the oblique direction (in the direction of the arrow in FIG. 2A)
Figure 2C:
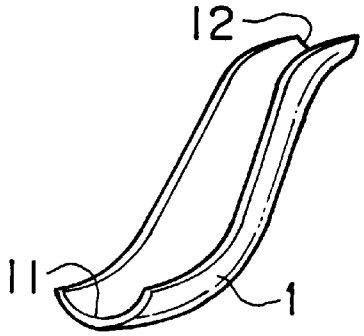
FIG. 2C is a perspective view of the gutter body.

The gutter body 1 shown in FIG. 2A–FIG. 2C is approximately an elongated bottomless half cut hollow cone. The transverse sectional shape of the central portion, the lower opening 11 and the upper opening 12 are all semi-circular. Furthermore, the side view shape is an overall elongated S-shape, with the central portion a straight line and the lower end and the upper end extended approximately horizontally towards the center and towards the periphery respectively in the rotation plane.

Figure 3A:
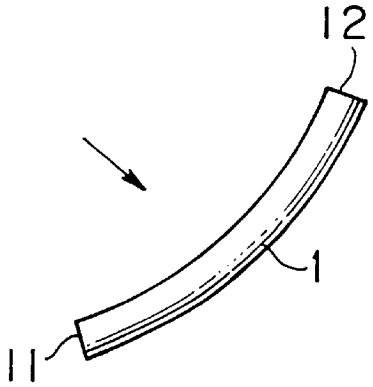
FIG. 3A shows a side view of another example of a gutter body.
Figure 3B:
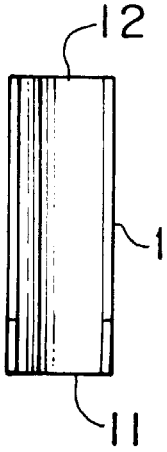
FIG. 3B is a front view seen from the oblique direction (in the direction of the arrow in FIG. 3A)
Figure 4A:
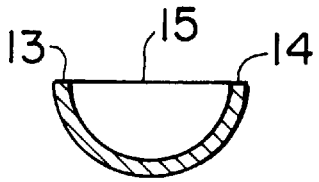
FIG. 4A to FIG. 4L show examples of transverse section of symmetrical shapes of opening portions of gutter bodies.
Figure 4B:
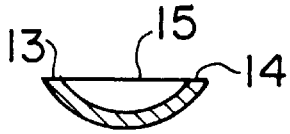
Figure 4C:
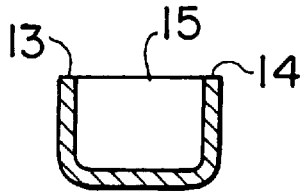
Figure 4D:
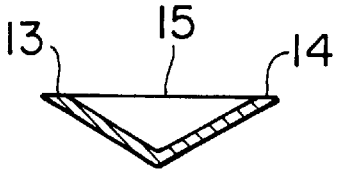
Figure 4E:
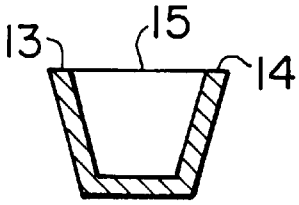
Figure 4F:
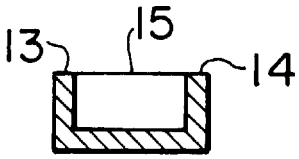
Figure 4G:
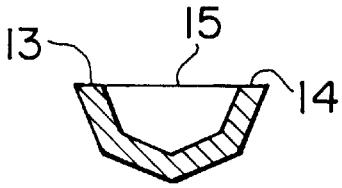
Figure 4H:
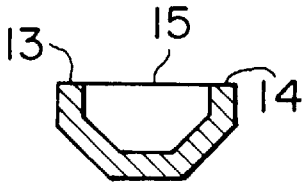
Figure 4I:
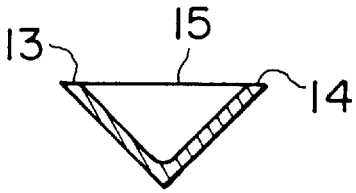
Figure 4J:
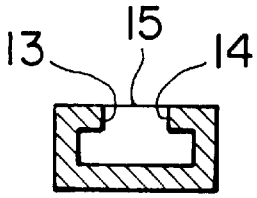
Figure 4K:
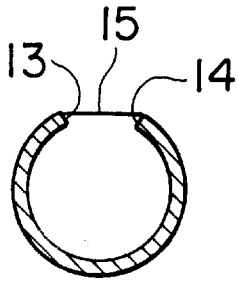
Figure 4L:
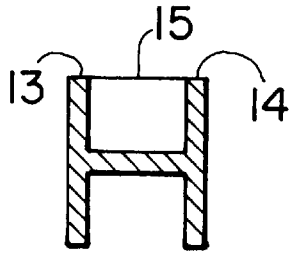
Figure 5A:
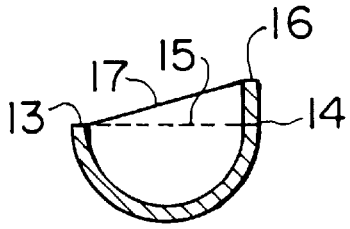
FIG. 5A to FIG. 5K show examples of transverse section of non-symmetrical shapes of opening portions of gutter bodies.
Figure 5B:
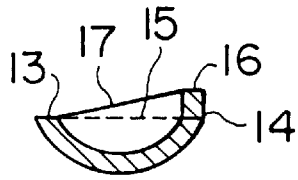
Figure 5C:
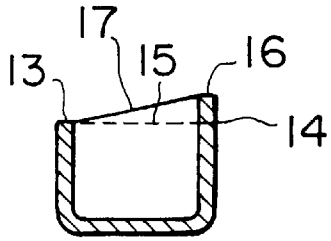
Figure 5D:
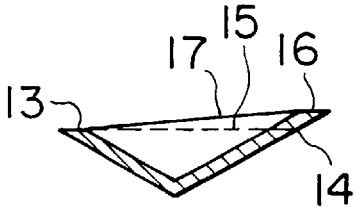
Figure 5E:
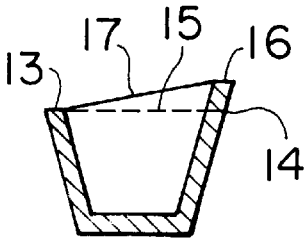
Figure 5F:
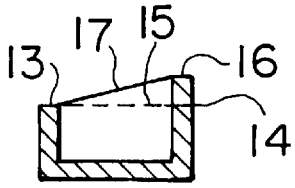
Figure 5G:
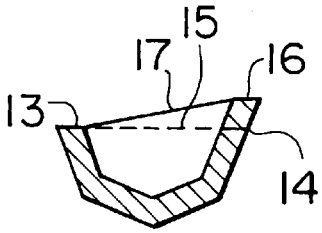
Figure 5H:
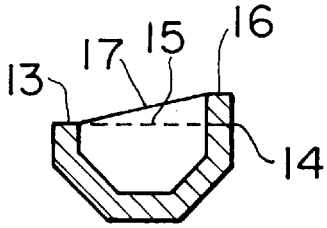
Figure 5I:
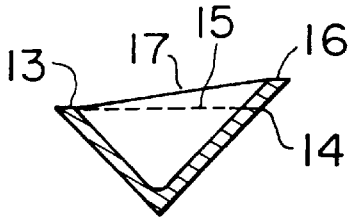
Figure 5J:
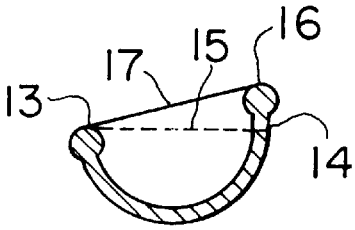
Figure 5K:
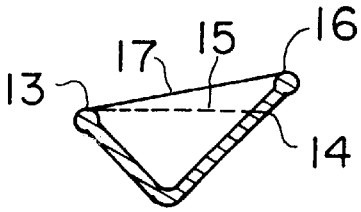

The gutter body 1 shown in FIG. 3A and FIG. 3B is approximately an elongated bottomless half cut cylinder. The transverse sectional shape of the central portion, the lower opening 11 and the upper opening 12 are all semi-circular. Furthermore, the side view shape is a parabola shape protruding downwards with a small curvature.

With these gutter bodies shown in FIG. 4A to FIG. 4L, there is an opening border 15 between opening edges 13 and 14. Moreover the cross-sectional area of the opening is the area of the shape enclosed by the peripheral surface of the gutter body and the opening border 15.

With these non-symmetrical shapes shown in FIG. 5A to FIG. 5K, there is an opening border 17 between the opening edge 13 and the extended portion edge 16. Moreover, the cross-sectional area of the opening is the area enclosed by the symmetrical shape of the peripheral surface of the gutter body and the aforementioned opening border 15 thereof, and the remaining area enclosed by the peripheral surface of the non-symmetrical shape of the gutter body and the opening border 17. The gutter body having a non-symmetrical shape as shown in FIG. 5A–FIG. 5K, is revolved with the opening edge 13 leading and the extended edge portion 16 following.

Figure 6A:
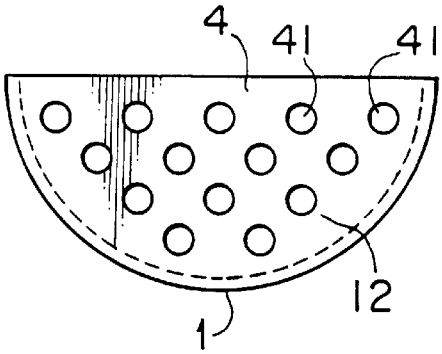
FIG. 6A shows an upper opening of a gutter body which is covered with a perforated plate.
Figure 6B:
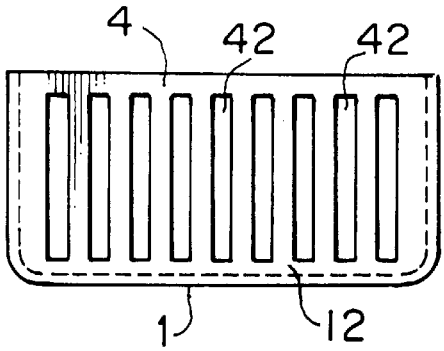
FIG. 6B shows the same part as in FIG. 6A which is covered with a plate having apertures.

In FIG. 6A, a perforated plate 4 covering an upper opening 12 of a semi-circular gutter body 1 is semi-circular in shape corresponding to the upper opening 12, with a plurality holes 41 randomly drilled therein. A perforated plate 4 covering a substantially rectangular shape upper opening 12 of a gutter body 1 shown in FIG. 6B, having corners rounded at two places, is substantially rectangular in shape with rounded corners corresponding to the upper opening 12, and has a plurality of elongate rectangular apertures 42 formed regularly therein with their longitudinal axes parallel with each other.

Figure 7A:
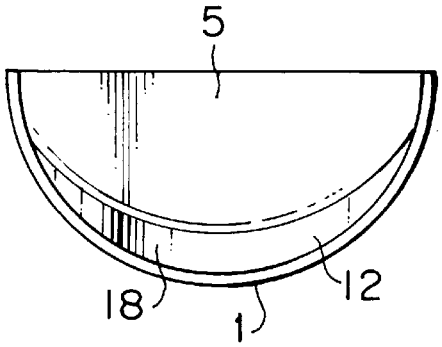
FIG. 7A shows an upper opening of a gutter body which is closed off by a plate such that a gap is formed along an inner peripheral surface of the upper opening.
Figure 7B:
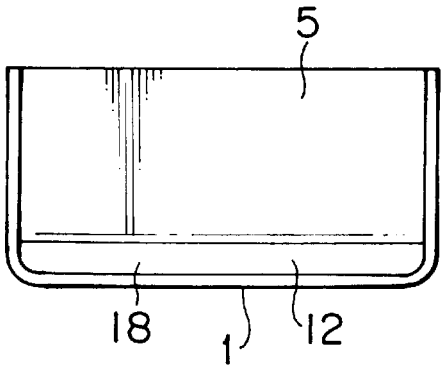
FIG. 7B shows another embodiment of the upper opening of gutter body for the same effect as in FIG. 7A.

In FIG. 7A, the upper opening 12 of the gutter body 1 is semi-circular in shape while the shape of the plate 5 is a semi-ellipse having a longitudinal axis of a length equal to the diameter of the semi-circle of the upper opening 12 of the gutter body 1. Hence the shape of the gap 18 is a crescent moon shape. In FIG. 7B, the upper opening 12 of the gutter body 1 is substantially rectangular in shape with the corners rounded at two places, while the shape of the plate 5 is rectangular with the long side equal to the length of the long side of the substantially rectangular upper opening 12, and the short side shorter than the length of the short side thereof. Hence the shape of the gap 18 is a narrow substantially rectangular shape with corners rounded at two places.

Figure 8A:
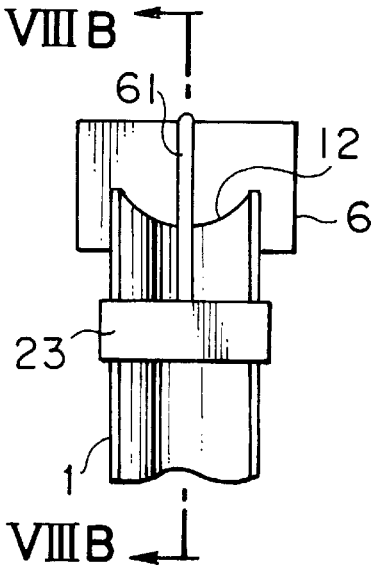
FIG. 8A is a plan view of a gutter body provided with a deflector plate spaced apart from the upper opening.
Figure 8B:
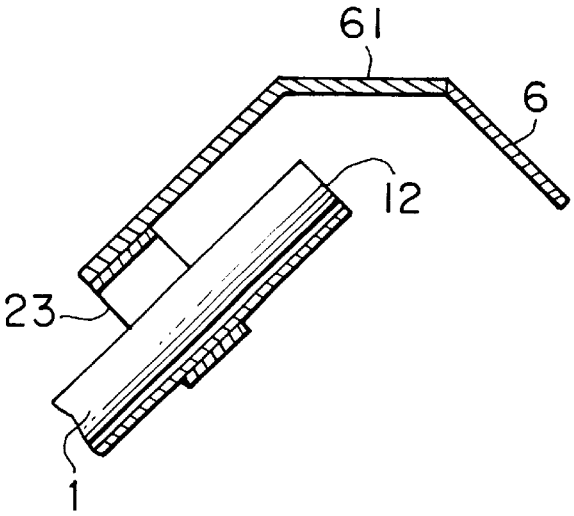
FIG. 8B is a sectional view on VIIIB—VIIIB shown in FIG. 8A.

In FIG. 8A and FIG. 8B, a rectangular deflector plate 6 is provided at right angles to the axial direction of the gutter body 1, and spaced apart from the upper opening 12 of the gutter body 1. Furthermore, the deflector plate 6 is mounted on the beforementioned retainer 23 for attaching the gutter body 1 to the attachment device 2, by means of a rod 61.

Figure 9:
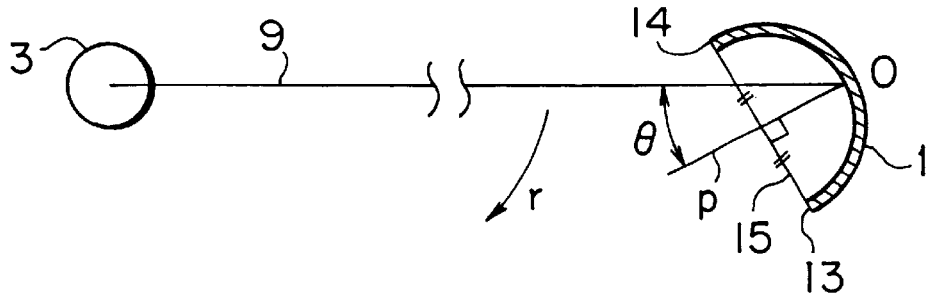
FIG. 9 is a diagram for explaining an eccentric or deviation angle.

The eccentric or deviation angle will now be explained with reference to FIG. 9. A perpendicular line dividing in two the opening border 15 being the line connecting the symmetrical shape opening edges 13 and 14 of the gutter body 1, is the center line p of the gutter body 1. The intersection point of the center line p of the gutter body 1 with the gutter body 1 is the central point o of the gutter body 1. The angle from a rotation plane radius 9 passing through the central point o of the gutter body 1 to the center line p in the direction of rotation r (shown clockwise in the figure) of the gutter body is the eccentric or deviation angle θ.

Figure 10:
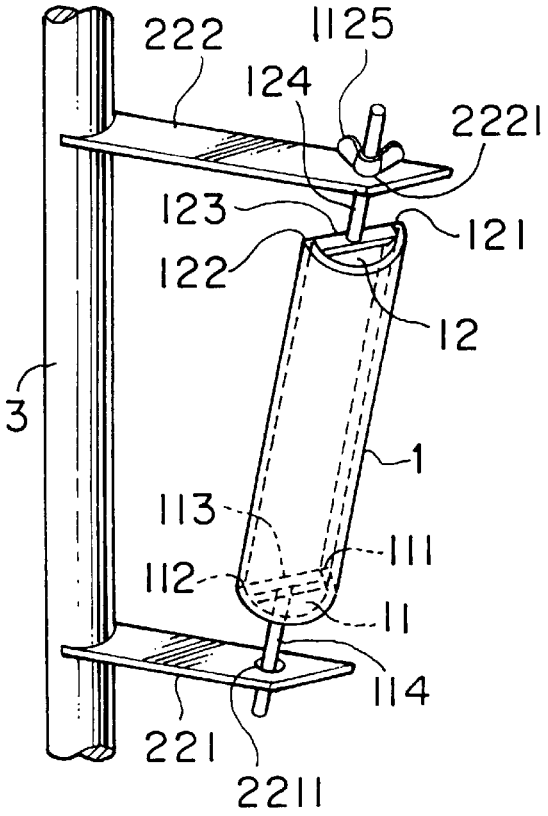
FIG. 10 is a perspective view of a gutter body revolvably mounted on an agitator shaft; said gutter body being rotatable by itself.

In FIG. 10, a lower support 113 is provided on a lower opening 11 of a gutter body 1, connecting opening edges 111 and 112 thereof. Moreover, an upper support 123 is provided on an upper opening 12 connecting opening edges 121 and 122 thereof. Cylindrical rods serving as a lower support rod 114 and an upper support rod 124, are respectively mounted aligned with the longitudinal axis of the gutter body 1, on the centers of the lower support 113 and the upper support 123.

A lower attachment device 221 and an upper attachment device 222 are secured radially to the agitator shaft 3. The lower attachment device 221 and the upper attachment device 222 are both slender rectangular shape plates, with the length of the lower attachment device 221 shorter than the length of the upper attachment device 222. The vertical spacing between the lower attachment device 221 and the upper attachment device 222 is made slightly greater than the vertical height of the inclined gutter body 1 (length of gutter body × sine of inclination angle). Apertures 2211 and 2221 are respectively drilled in tip portions of the lower attachment device 221 and the upper attachment device 222.

The lower support rod 114 and the upper support rod 124 of the gutter body 1 are respectively inserted into the aperture 2211 of the lower attachment device 221 and the aperture 2221 of the upper attachment device 222. A wing nut 1125 is threaded onto the upper support rod 124 to contact with the upper face of the upper attachment device 222.

The gutter body 1, when turned about the agitator shaft, is thus automatically turned depending on the rotational speed of the agitator shaft. Alternatively, the gutter body 1 may be secured after turning to give a desired eccentric or deviation angle.

Securing the gutter body 1 is effected by threading a nut onto the upper support rod 124 and clamping the upper attachment device 222 between the nut and the wing nut 1125, and/or threading two nuts onto the lower support rod 114 and clamping the lower attachment device 221 between these two nuts.

In the case of FIG. 10, the gutter body is turned with the longitudinal opening of the gutter body leading, and the protruded portion (the bottom of curved surface of the gutter body defined similarly hereunder) following. So does when the gutter body is twisted.

Figure 11:
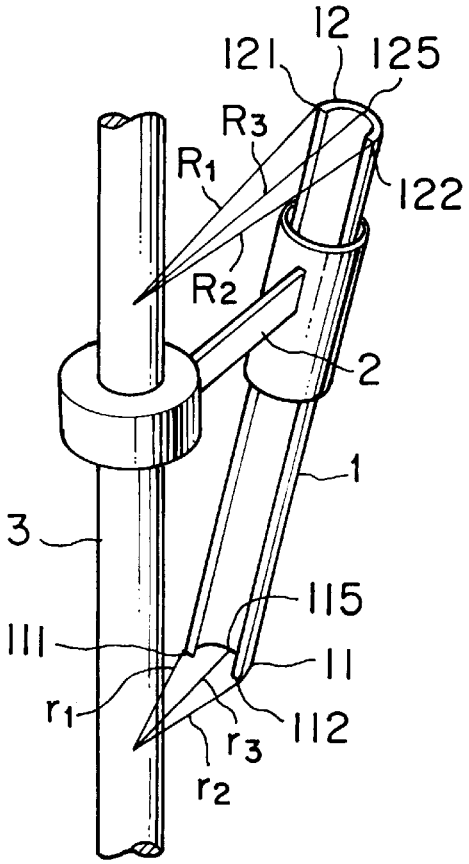
FIG. 11 is a diagram for illustrating a positional relationship of a gutter body fitted to an agitator shaft, and a perspective view of the right half (right side) of FIG. 1B.
Figure 12A:
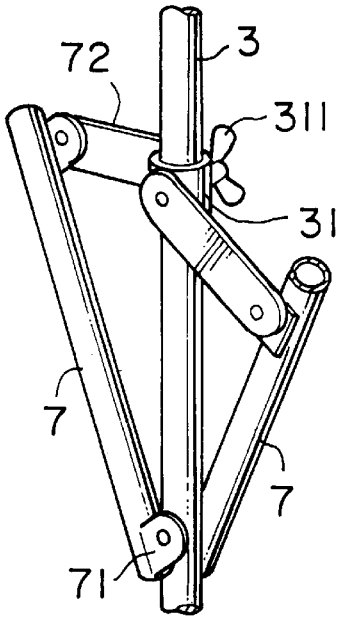
FIG. 12A to FIG. 12D are respectively a perspective view, a plan view, a front view, and a side view of a liquid ejection apparatus having a tubular body, with the size of an inclination angle adjustable by means of a vertical system.
Figure 12B:
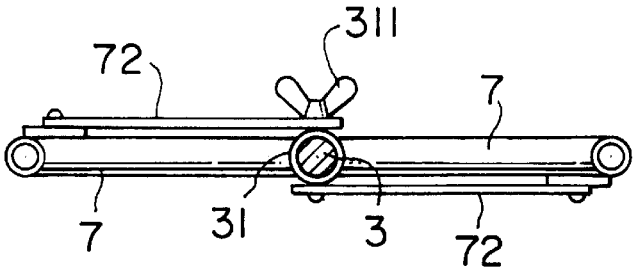
Figure 12C:
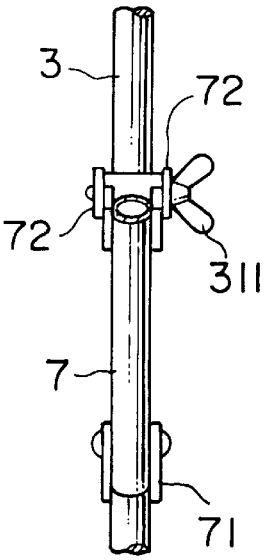
Figure 12D:
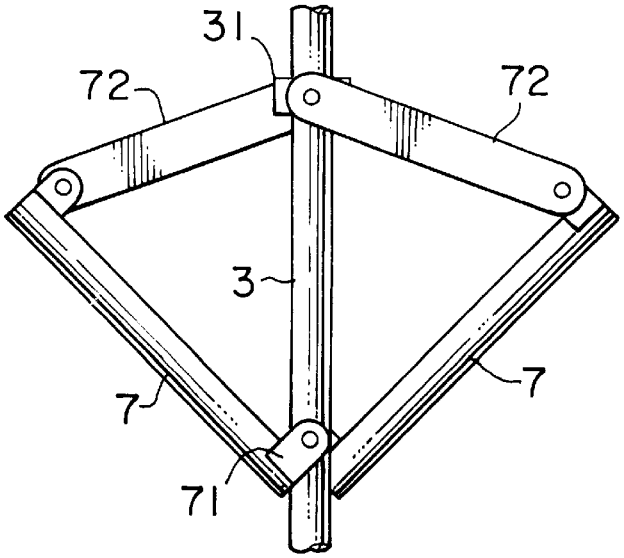
Figure 13A:
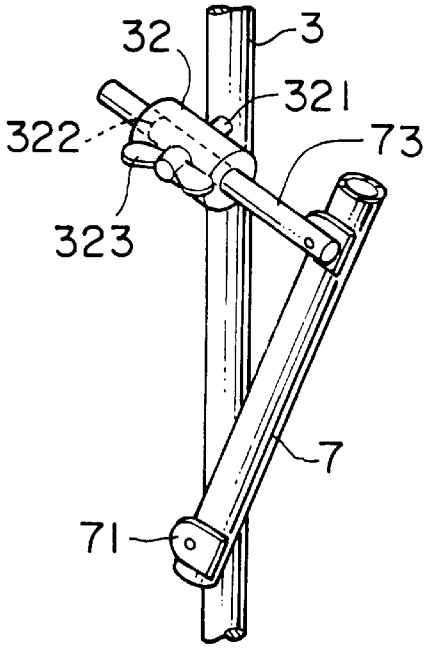
FIG. 13A to FIG. 13D are respectively a perspective view, a plan view, a front view, and a side view of liquid ejection apparatus having tubular bodies, with the size of the inclination angle adjustable by a horizontal system; the agitator shaft in FIG. 13B is shown as a cross-sectional end face.
Figure 13B:
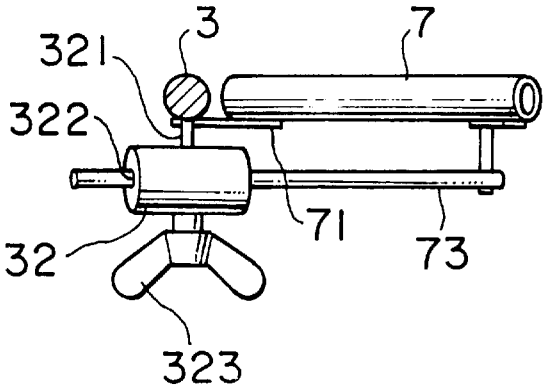
Figure 13C:
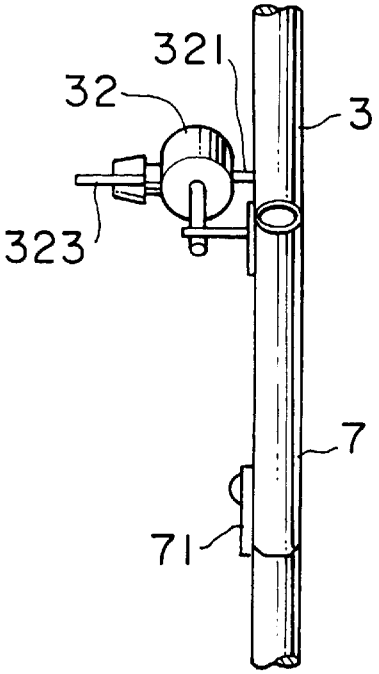
Figure 13D:
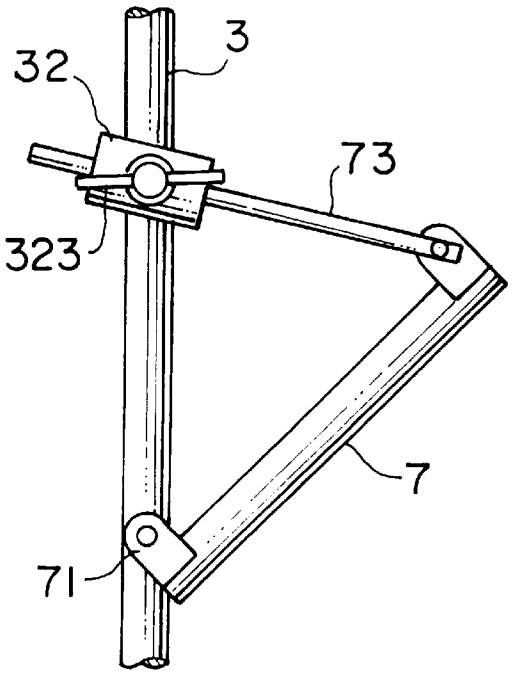
Figure 14A:
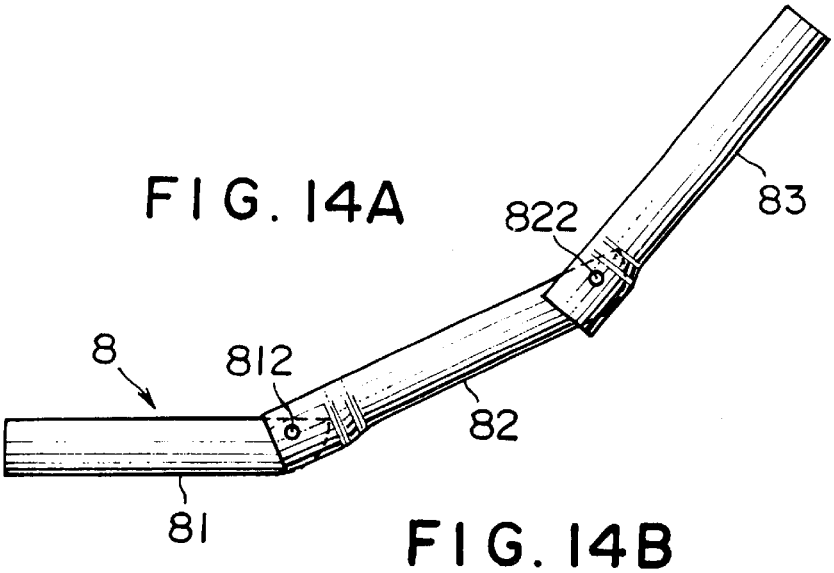
FIG. 14A shows a side view of a bent gutter body.
Figure 14B:
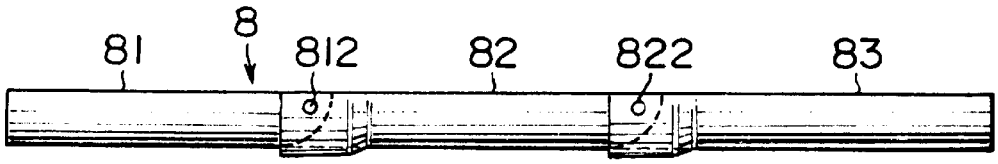
FIG. 14B through FIG. 14D show respectively a side view, a plan view and an end view of the straightened gutter body.
Figure 14C:
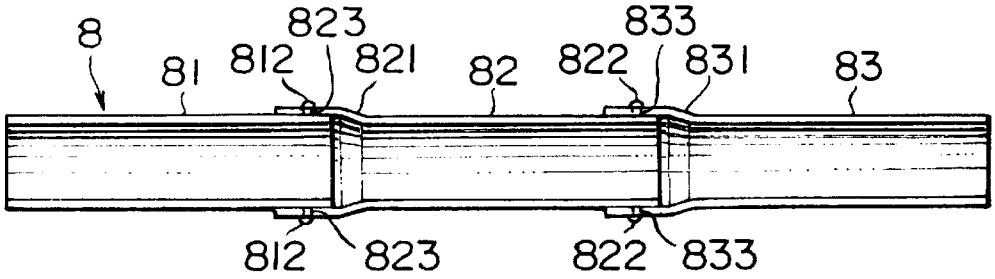
Figure 14D:
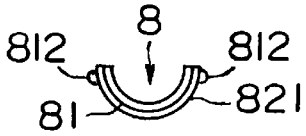
Figure 14E:
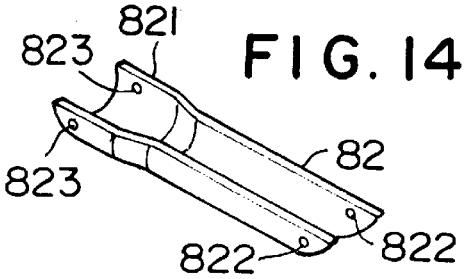
FIG. 14E through FIG. 14G show respective perspective, side and end views of gutter segments.
Figure 14F:
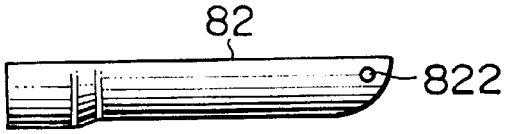
Figure 14G:
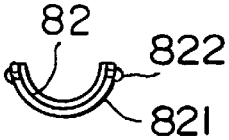
Figure 15A:
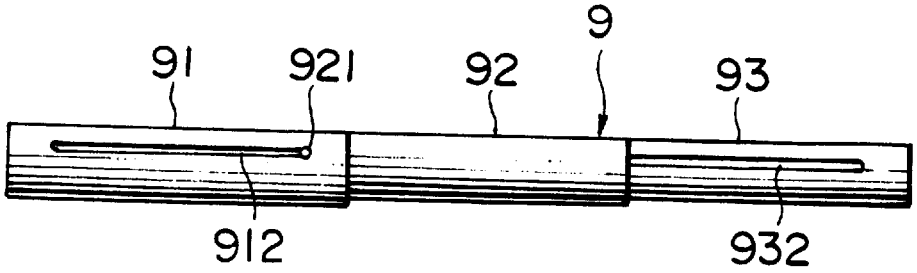
FIG. 15A and FIG. 15B show respectively a side view and a plan view of an extended gutter body which can be telescoped.
Figure 15B:
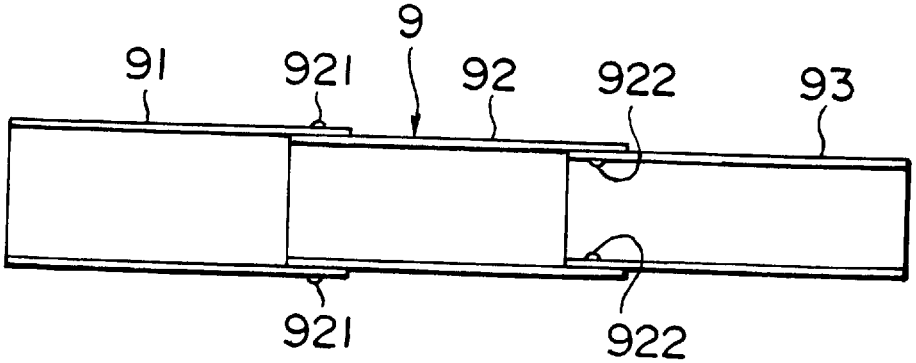
Figure 15C:
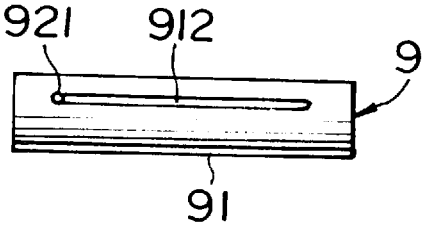
FIG. 15C and FIG. 15D show respectively a side view and plan view of a contracted gutter body.
Figure 15D:
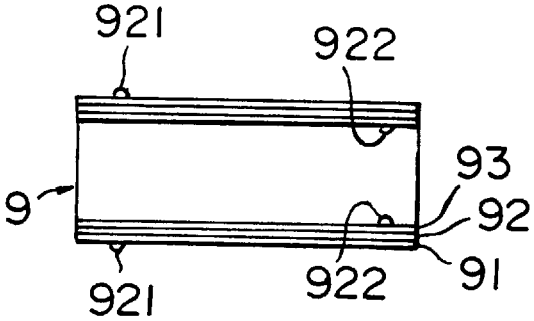

In FIG. 11, r1, r2 and r3 denote respective distances in the revolving plane of the lower opening 11 of the gutter body 1, from the center of the agitator shaft 3, to the opening edge 111 on the left side (left side when viewed from the agitator shaft; defined similarly hereunder), to the opening edge 112 on the right side, and to the protruded portion 115. Symbols R1, R2 and R3 denote the respective distances in the revolving plane of the upper opening 12 of the gutter body 1, from the center of the agitator shaft 3, to the opening edge 121 on the left side, to the opening edge 112 on the right side, and to the protruded portion 125.

With the liquid ejection apparatus shown in FIG. 11, it is preferable to satisfy the relationship r1<r3, r2<r3, and R1<R3, R2<R3 and r3<R3. However, it is also possible to have r1<r3, r2<r3 and R1<R3, R2<R3 and r3=R3. Now r1, r2 and r3 are all on one revolving plane, and R1, R2 and R3 are all on another revolving plane.

In FIG. 12A–FIG. 12D, each tubular body 7 has a lower end secured to the agitator shaft 3 by means of a hinge plate 71, and an upper end is connected to a sliding ring 31 by means of a connecting link 72. The sliding ring 31 is mounted so as to be slidable on the agitator shaft 3. Furthermore, a wing screw 311 is provided on the sliding ring 31 for securing the sliding ring 31 at an optional position. The connecting link 72 and the sliding ring 31 constitute a vertical traveller device.

By moving the sliding ring 31 along the agitator shaft 3 perpendicular to the revolution plane, then the size of the inclination angle of the tubular bodies 7 can be adjusted. Once the inclination angle of the tubular bodies 7 is at a predetermined size, the sliding ring 31 is secured to the agitator shaft 3 by the means of the wing screw 311.

In FIG. 13A–FIG. 13D, each tubular body 7 has a lower end secured to the agitator shaft 3 by means of a hinge plate 71, and an upper end connected to a pivot collar 32 by means of a connecting rod 73. The pivot collar 32 is supported on a pivot shaft 321 so as to pivot in a parallel plane with the agitator shaft 3. Furthermore a bore 322 is drilled in the center of the pivot collar 32 along the longitudinal axis thereof for insertion of the connecting rod 73. A wing screw 323 is provided on the pivot collar 32 for securing the connecting rod 73, when the connecting rod 73 is inserted into the bore 322 of the pivot collar 32. The connecting rod 73 and the pivot collar 32 constitute a horizontal traveller device.

By moving the connecting rod 73 which is inserted into the bore 322 of the pivot collar 32 substantially along the rotation plane of the tubular bodies 7, then the size of the inclination angle of the tubular bodies 7 can be adjusted. Once the inclination angle of the tubular bodies 7 is at a predetermined size, the connecting rod 73 is secured to the agitator shaft 3 via the pivot collar 32 by means of the wing screw 323.

In FIG. 14A–FIG. 14G, a gutter body 8 is made up of three sections, namely in order from the lower end, a lower gutter section 81, a central gutter section 82, and an upper gutter section 83. The lower gutter section 81, the central gutter section 82 and the upper gutter section 83 are all substantially the same as each other in transverse section shape, being a semi-circular shape. However the central gutter section 82 and the upper gutter section 83 are formed with expanded portions 821, 831 which are expanded so that respective lower ends thereof can accommodate the respective upper ends of the lower gutter section 81 and the central gutter section 82. Moreover, the respective upper end portions of the lower gutter section 81 and the central gutter section 82 are formed as a quadrant as seen from the side. These quadrants have centers near the respective longitudinal openings of the lower gutter section 81 and the central gutter section 82. Nock pins 812 and 822 are respectively threaded into the centers of the quadrants. Nock pin holes 823 and 833 are respectively drilled near the longitudinal opening of the respective lower end portions of the central gutter section 82 and the upper gutter section 83, for insertion of the nock pins 812, 822 in the gutter section upper end portions. With the gutter body 8, the nock pins 812, 822 and the nock holes 823, 833 constitute joint members.

The lower gutter section 81 and the central gutter section 82 are connected by inserting the upper end of the lower end gutter section 81 into the expanded portion 821 on the lower end of the central gutter section 82, and inserting the nock pins 812 of the lower gutter section 81 into the nock pin holes 823 in the central gutter section 82. The central gutter section 82 and the upper gutter section 83 are similarly connected to thereby form a single gutter body 8.

The gutter body 8 can thus be optionally bent or straightened by moving the upper end along the axis of the agitator shaft.

In FIG. 15A–FIG. 15D, a gutter body 9 is made of three sections, namely in order from the lower end, a lower gutter section 91, a central gutter section 92, and an upper gutter section 93. The lower gutter section 91, the central gutter section 92 and the upper gutter section 93 are made successively narrower, with transverse section shapes being semi-circular shapes substantially resembling each other. Nock pins 921 and 922 are respectively threaded into the lower end outside and the upper end inside of the central gutter section 92 near the longitudinal opening. Furthermore, elongate slots 912 and 932, are respectively formed in the lower gutter section 91 and the upper gutter section 93 (except at the opposite ends) near the longitudinal opening and parallel with the peripheral rim thereof, at positions corresponding to the respective nock pins 921 and 922.

The lower gutter section 91 and the central gutter section 92 are connected by fitting the central gutter section 92 inside the lower gutter section 91 and respectively engaging the nock pins 921 of the central gutter section 92 with the slots 912 of the lower gutter section 91. The central gutter section 92 and the upper gutter section 93 are similarly connected to thereby form a single gutter body 9.

The gutter body 9 can thus be extended and contracted by moving the tip end along the longitudinal axis of the gutter body 9 so that the gutter segments slide relative to each other.

Figure 16A:
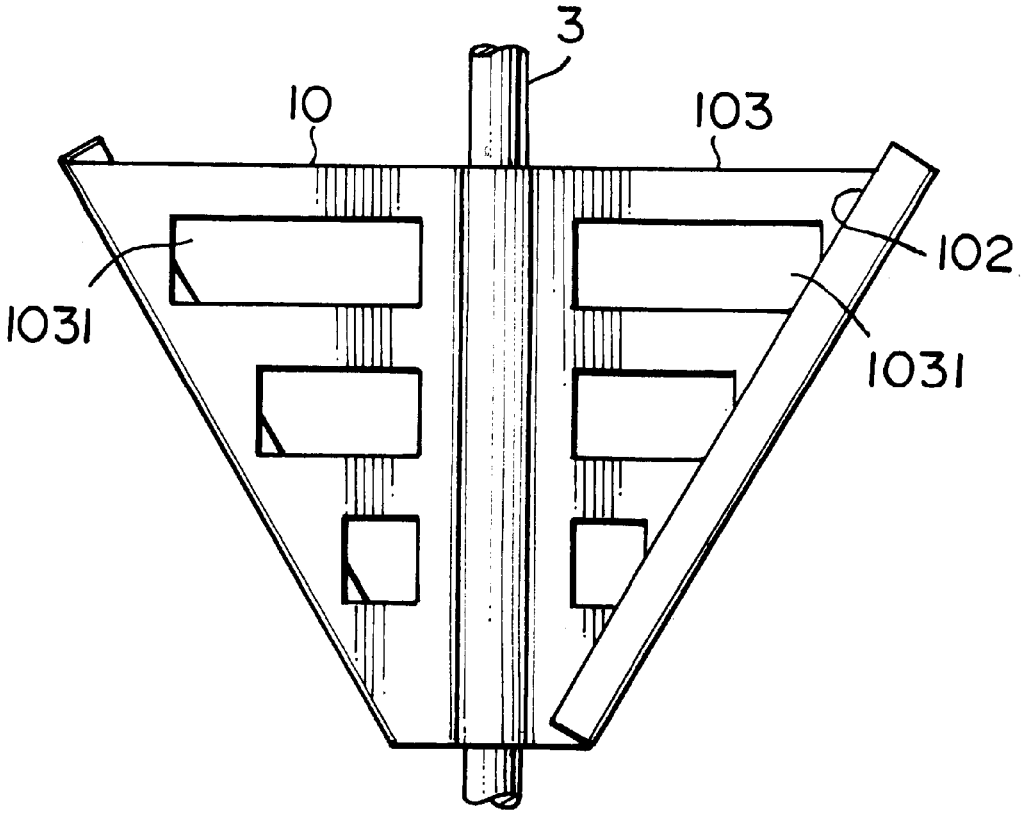
FIG. 16A and FIG. 16B show respective front and plan views of a liquid ejection apparatus having two opposite gutter bodies formed integral with each other; the agitator shaft in FIG. 16B is shown as a cross-sectional end face.
Figure 16B:
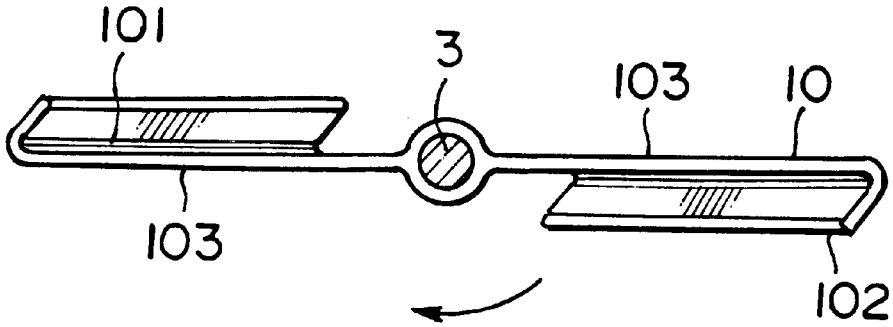

In FIG. 16A–FIG. 16B, an inverse trapezoid shape plate 10 is attached to the agitator shaft 3, with opposite inclined side portions thereof bend in opposite directions to each other in the rotation plane to thereby form two opposed gutter bodies 101, 102. The respective shapes of the upper opening and the lower opening of the gutter bodies 101, 102 are both non-symmetrical V-shapes with one side longer and with rounded vertices. Moreover, unbent flat portions 103 of the trapezoid plate 10 constitute an attachment device, which in addition acts as an agitator blade. Six rectangular openings 1031 are formed transversely in the flat portions 103 to reduce fluid resistance.

The gutter bodies 101, 102 are revolved so that the short side of the non-symmetrical V-shape leads (clockwise in the figure).

Figure 17A:
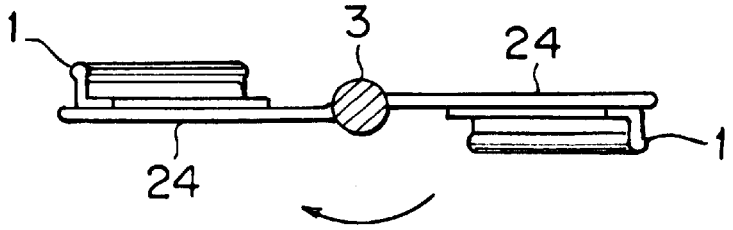
FIG. 17A and FIG. 17B show respective plan and front views of a liquid ejection apparatus having gutter bodies attached eccentric or deviationally; the agitator shaft in FIG. 17A is shown as a cross-section end face.
Figure 17B:
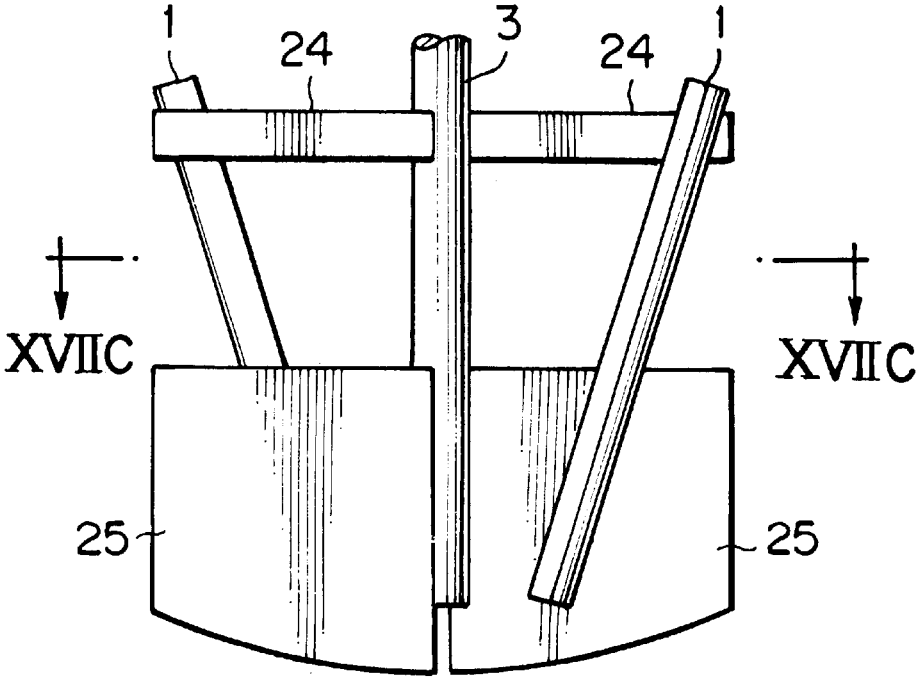
Figure 17C:
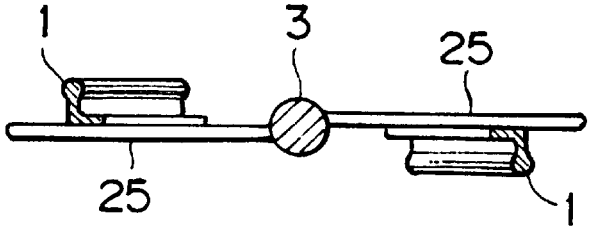
FIG. 17C is a sectional view on section XVIIC—XVIIC shown in FIG. 17B.

In FIG. 17A–FIG. 17C, two gutter bodies 1 are attached to the agitator shaft 3 at an incline thereto with their lower openings closer to the agitator shaft 3 than their upper openings, upper portions thereof being attached by means of an elongate rectangular plate attachment device 24, and lower portions being attached by means of a trapezoid plate attachment device 25. Both the attachment devices 24 and 25 are secured eccentric or deviationally with respect to the agitator shaft 3.

With the gutter bodies 1, the respective shapes of the upper opening and the lower opening are both V-shaped with a 90° vertex angle. One side is secured to the attachment devices 24, 25, while the tip end of the other side is enlarged.

The two gutter bodies 1 are fixedly mounted eccentric or deviationally with respect to the agitator shaft 3 on opposite side faces of the attachment devices 24, 25.

The gutter bodies 1 are revolved so to as to lead the attachment devices 24, 25 (clockwise in the figure).

In FIG. 16B and FIG. 17A, vertex angles of the V-shaped gutter bodies may be varied up to 105°. In addition, the V-shaped gutter bodies may be replaced by any shape shown in FIG. 4A–FIG. 5J, for example, a semi-circular shape.

Figure 18A:
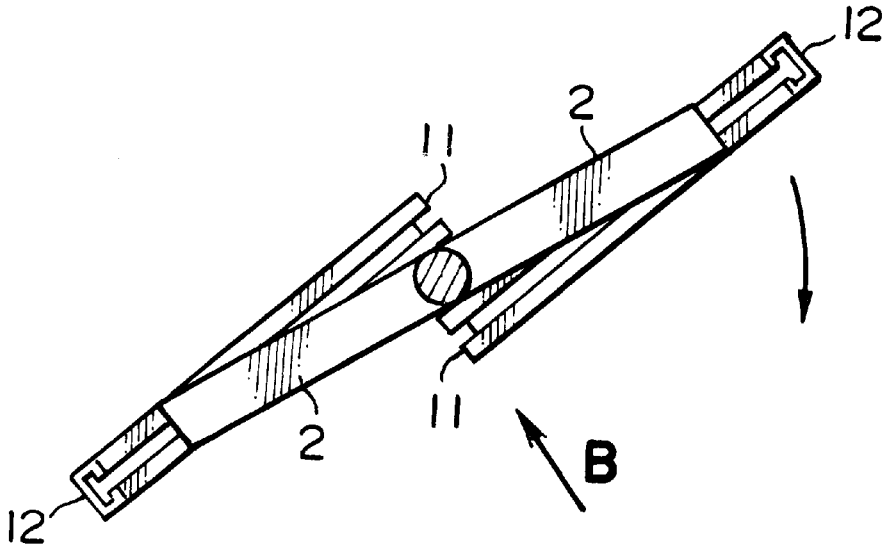
FIG. 18A and FIG. 18B are respectively a plan view and a front view (a view on arrow B in FIG. 18A) of another liquid ejection apparatus having gutter bodies attached eccentric or deviationally; the agitator shaft in FIG. 18A is shown as a cross-section end face.
Figure 18B:
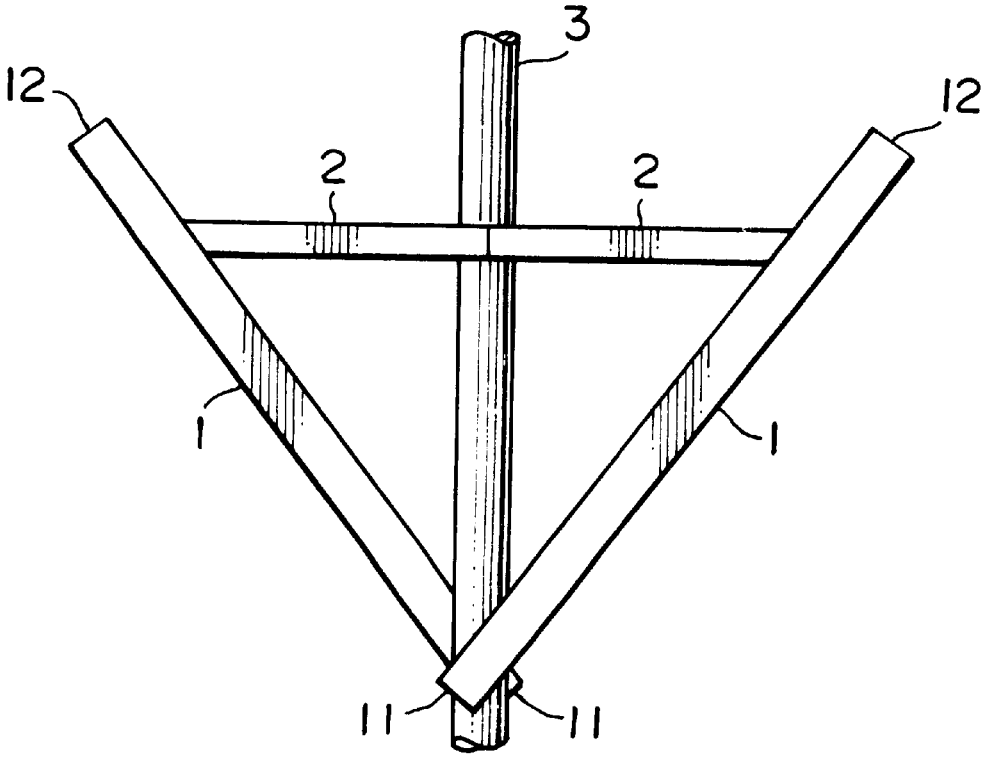

In FIG. 18A–FIG. 18B, elongate rectangular plate attachment devices 2 are located on the radius of the rotation plane and secured to the agitator shaft 3. The length of the attachment devices 2 are substantially the same as each other. Two C-sections of rectangular shape in cross-section constitute the gutter bodies 1. The longitudinal openings are faced inwards, with respective upper portions secured to the tip ends of the attachment devices 2, and lower portions secured to the peripheral surface of the agitator shaft 3, so that lower openings 11 are closer to the agitator shaft 3 than upper openings 12, thereby inclining the gutter bodies 1.

The lower portions of the gutter bodies 1 are secured to the peripheral surfaces on opposite sides of the agitator shaft 3. Hence the lower openings 11 of the gutter bodies 1 are eccentric or deviation with respect to the agitator shaft 3, and cross over each other at the position of the agitator shaft 3.

The gutter body 1 is usually turned with the lower openings 11 leading and the upper openings 12 following (clockwise in the figure).

Figure 19:
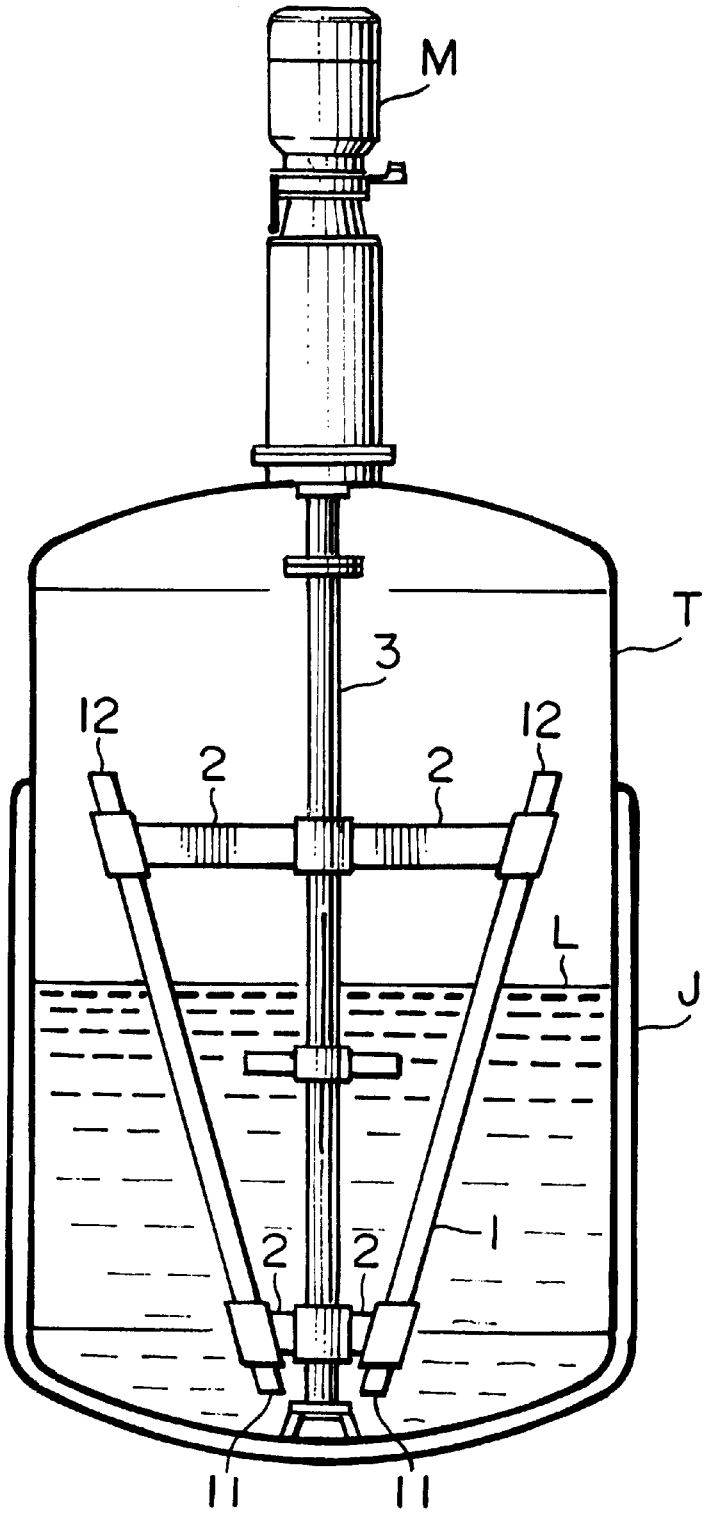
FIG. 19 is a longitudinal section view of an agitator tank with a liquid ejection apparatus installed thereinside.

In FIG. 19, a liquid ejection apparatus similar to that shown in FIG. 1A with the exception that two attachment devices 2 (upper and lower) are used to attach the gutter bodies 1 to the agitator shaft 3, is installed centrally inside an agitator tank T. An upper end of the agitator shaft 3 is connected to an electric motor M mounted on an upper base plate of the agitator tank T. A jacket J is positioned around the outer periphery of the peripheral wall and over the base of the agitator tank T.

The lower opening 11 of the gutter body 1 is immersed below a level L of the liquid inside the agitator tank T, while the upper opening 12 is exposed in the space above the level L of the liquid. Rotation of the agitator shaft by driving the motor M mounted on the upper base plate of the agitator tank T to thereby revolve the gutter body 1, makes the liquid inside the agitator tank T to pass from the lower opening 11 of the gutter body 1 via the interior of the gutter body 1 to be ejected as ejected liquid from the upper opening 12. The ejected liquid is distributed onto the inner peripheral surface of the wall of the agitator tank T, and/or into the space above the liquid level L. Moreover, the parts of the gutter body 1 below the liquid level L and the attachment device 2 below the liquid level L both act as agitating blades.

Even when the liquid level L is lowered by evaporation, enough liquid is ejected from the opening 12, because the raise of liquid through the gutter body 1 is due to centrifugal force. This serves to keep heat transfer area at a constant level and also to keep constant evaporation speed, thereby to shorten evaporation time.

Figure 20:
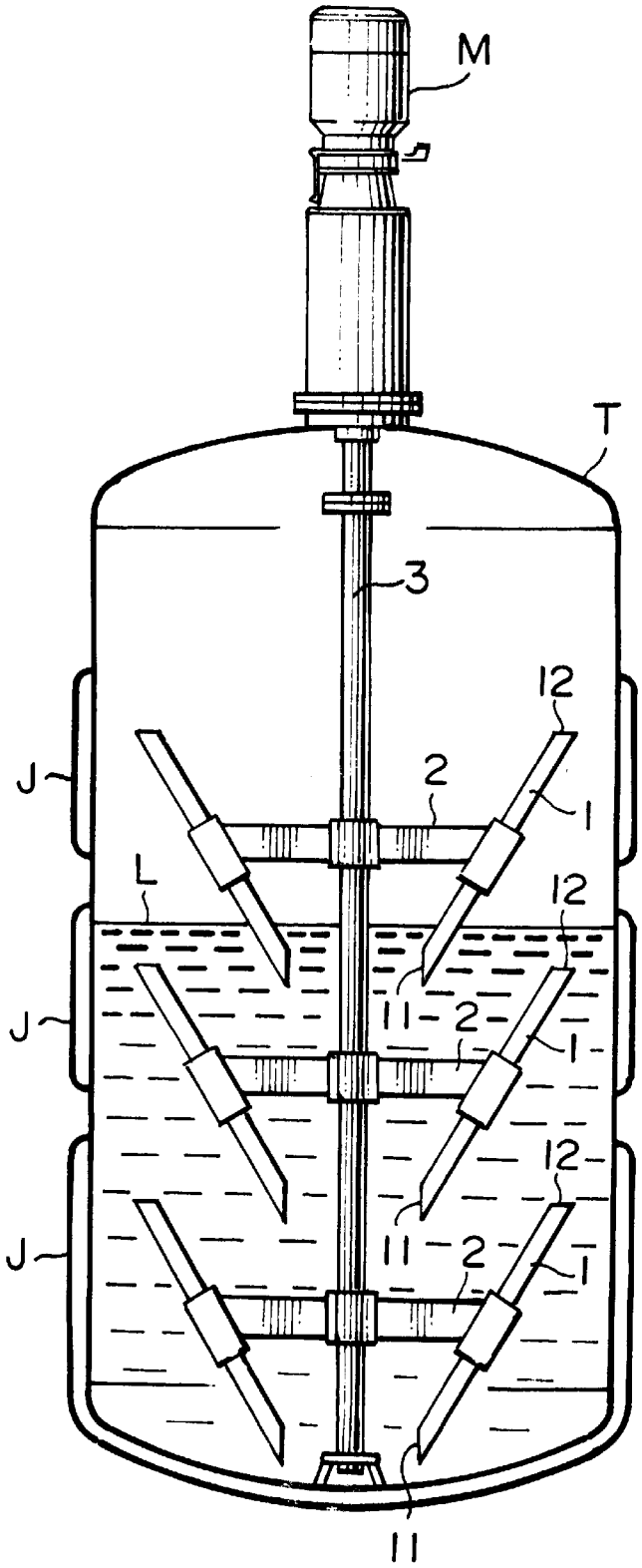
FIG. 20 is a longitudinal section view of an agitator tank with a liquid ejection apparatus having a plurality of gutter bodies attached along the longitudinal axis of the agitator shaft, installed thereinside.

In FIG. 20, three liquid ejection apparatuses similar to that shown in FIG. 1A are connected to an agitator shaft inside an agitating tank T similar to that shown in FIG. 19. An upper opening 12 of a gutter body 1 of a first stage (starting from the bottom; defined similarly hereunder) is above a lower opening 11 of a gutter body 1 of a second stage. Similarly, an upper opening 12 of the gutter body 1 of the second stage is above a lower opening 11 of a gutter body 1 of a third stage.

In FIG. 20, the level L of the liquid inside the agitator tank T is between the lower opening 11 and the upper opening 12 of the gutter body 1 of the third stage. Drive of the motor M to rotate the agitator shaft 3, to thereby revolve the gutter bodies 1, makes the liquid inside the agitator tank T to pass from the lower opening 11 via the gutter body 1 to be ejected as ejected liquid from the upper opening 12. The ejected liquid is distributed onto the inner peripheral surface of the wall of the agitator tank T, and/or into the space above the liquid level L. Moreover, the parts of the gutter body 1 below the liquid level L, and the gutter bodies 1 and the attachment devices 2 below the liquid level L all act as agitating blades.

With elapse of time and the accompanying drop in the liquid level L, then before the liquid level falls below the lower opening 11 of the gutter body 1 of the third stage, the upper opening 12 of the gutter body 1 of the second stage becomes exposed above the liquid level L. Hence the liquid inside the agitator tank T continues to be ejected from the upper opening 12. In this way, the liquid inside the agitator tank T is continuously ejected from the upper openings 12 of the gutter bodies 1 without any interruption, until the liquid level L reaches the lower opening 11 of the first stage gutter body 1.

Figure 21:
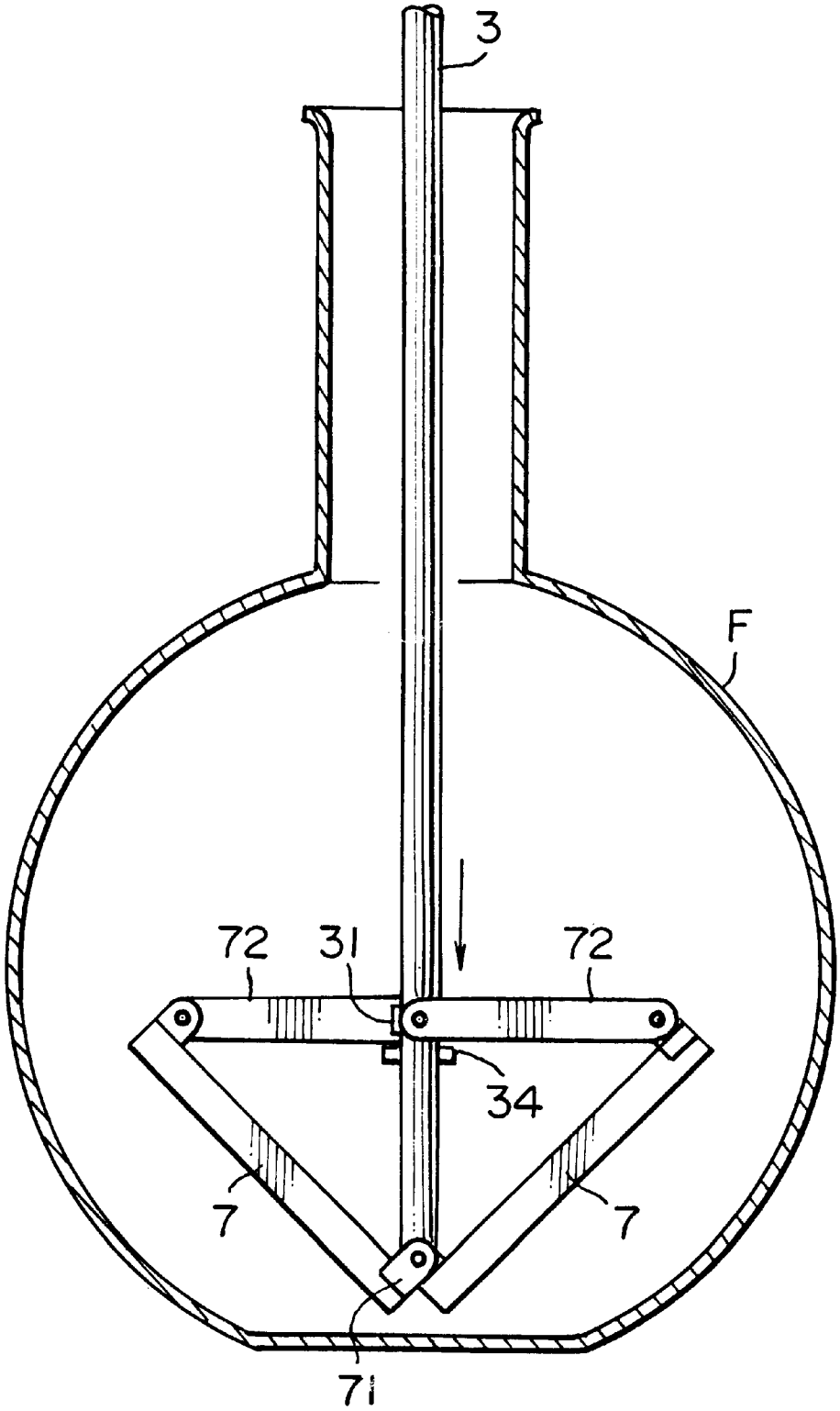
FIG. 21 is a longitudinal section view of a flask with a liquid ejection apparatus installed thereinside.

In FIG. 21, a liquid ejection apparatus having gutter bodies 7 with the size of the inclination angle adjustable by means of a vertical system similar to that shown in FIG. 12, except that the wing screw 311 is omitted and a stopper 34 is secured to the lower portion of the agitator shaft 3, is installed inside a flask F.

While outside of the flask F, the sliding ring 31 of the liquid ejection apparatus is slid upward along the surface of the agitator shaft 3 so that the inclination angles of the gutter bodies 7 are increased and the upper ends of the gutter bodies 7 approach the agitator shaft 3, bringing the gutter bodies 7 closer together. The liquid ejection apparatus is then inserted into the flask through the opening and the sliding ring 31 released, thus dropping down along the agitator shaft 3 until it contacts against the stopper 34, reducing the inclination angle to a predetermined size. The stopper 34 can be omitted. In this case the inclination angle of the gutter bodies 1 becomes a size corresponding to the rotational speed, and/or the length of the connecting link 72.

Figure 22A:
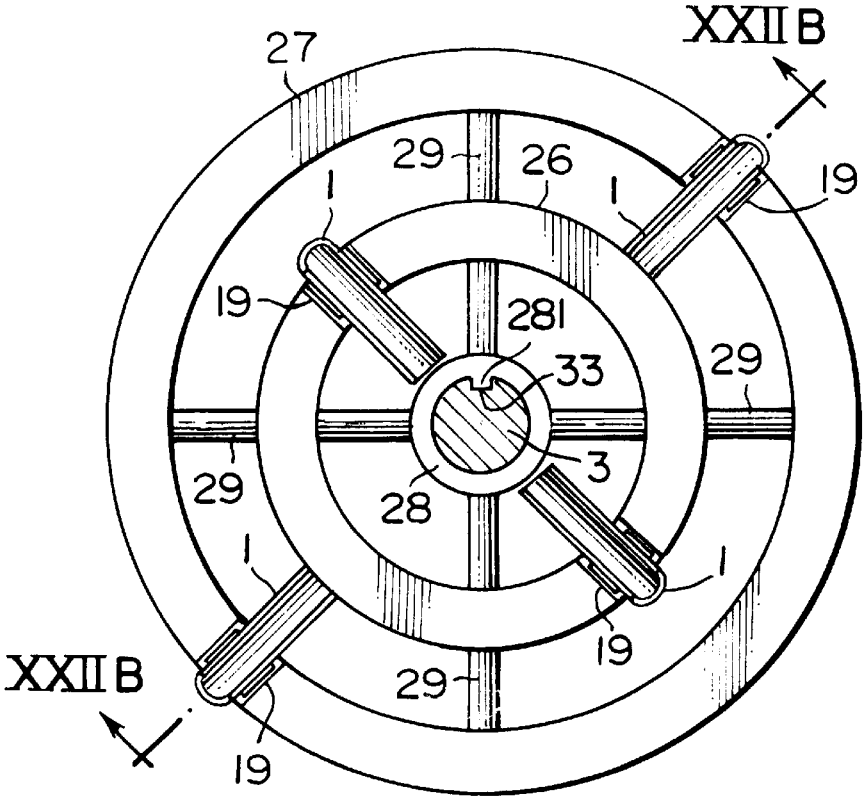
FIG. 22A is a plan view of a liquid ejection apparatus with a floating element dual purpose attachment device mounted on the agitator shaft, so as to be slidable thereon.
Figure 22B:
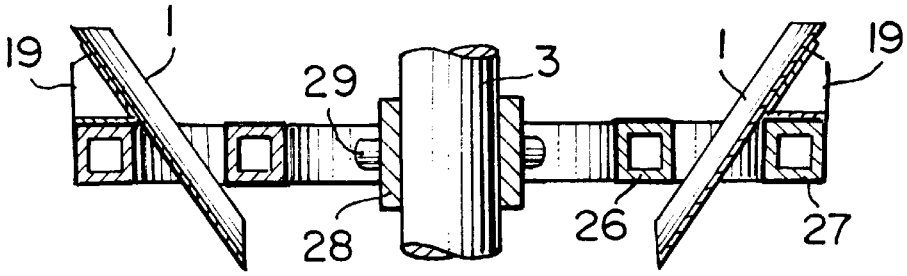
FIG. 22B is a cross-sectional view on section XXIIB—XXIIB shown in FIG. 22A.
Figure 22C:
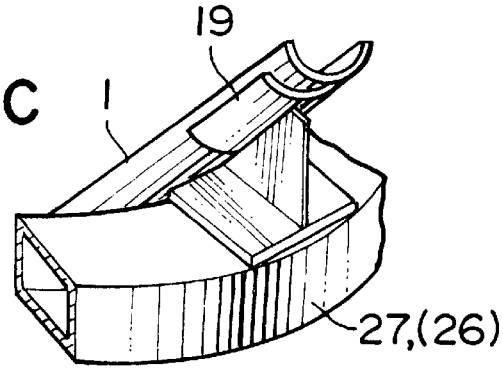
FIG. 22C is an enlarged perspective view of an attachment portion of the floating element dual purpose attachment device of the gutter body.

In FIG. 22A–FIG. 22C, the floating elements are a small diameter float 26 and a large diameter float 27, both annular shaped and approximately rectangular shape in cross-section, positioned concentrically with each other on the same rotation plane. Two sets of gutter bodies 1 with two gutter bodies per set each located on the same diameter on either side of the agitator shaft 3 are attached to the floats 26, 27 with the central angle of the gutter body pairs at 90°. One set of gutter bodies is long, while the other set is short. Furthermore, the gutter bodies 1 are respectively attached to the floats 26 and 27 by means of retainers 19. The floats 26, 27 are connected to a central ring 28 at their centers by means of support rods 29. The central angle of the support rods 19 is a right angle.

A protuberance 281 is provided on the inner peripheral face of the central ring 28. Furthermore, a groove 33 is formed along the longitudinal axis of the agitator shaft 3 in the outer peripheral face thereof. The agitator shaft 3 is inserted into the central ring 28, so that the protuberance 281 of the central ring 28 is engaged in the groove 33 of the agitator shaft 3, thereby mounting the floats 26, 27 on the agitator shaft 3 so as to be slidable thereon.

This liquid ejection apparatus always floats on the liquid surface so that irrespective of changes in the level of the liquid surface, the liquid is continuously and infallibly ejected from the upper openings 12 of the gutter bodies 1.

Figure 23A:
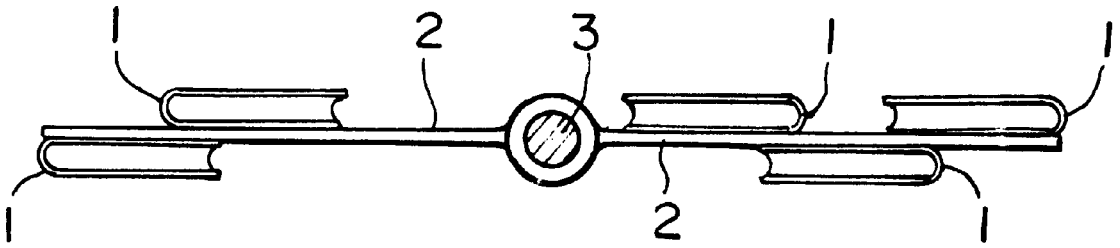
FIG. 23A and FIG. 23B are respective plan and front views of a liquid ejection apparatus with a plurality of gutter bodies attached to a single attachment device.
Figure 23B:
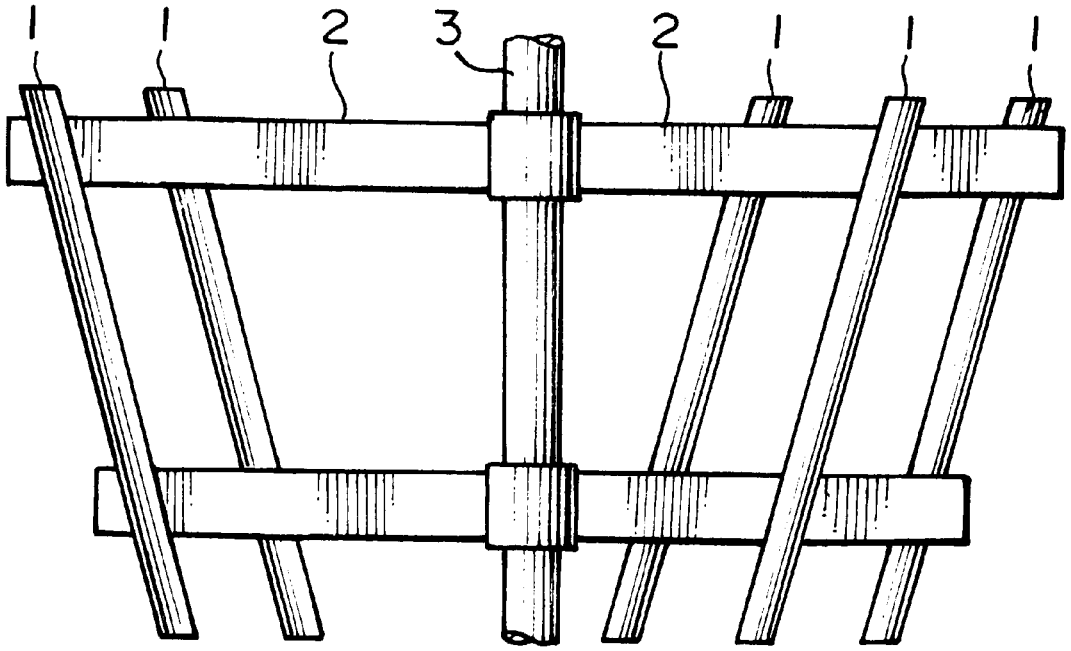

In FIG. 23A–FIG. 23B, attachment devices 2 of the same length as each other are located on either side of the agitator shaft 3 on the same diameter. Two gutter bodies 1 are attached to one attachment device (the left side in the figure), and three gutter bodies 1 are attached to the other attachment device (the right side in the figure). The inclination angles of these gutter bodies are the same as each other. However, the distances from the agitator shaft 3 to the respective gutter bodies 1 are all different so that when the agitator shaft 3 is rotated to thereby rotate the gutter bodies 1, the paths, that is circular tracks, of the five gutter bodies 1 do not overlap each other.

With the liquid ejection apparatus of the present invention, the construction is simple, and by merely rotating the agitator shaft, the liquid can be ejected over a large ejection distance with a large ejection volume. By means of this ejected liquid, washing of an inner peripheral surface of a tank wall, maintenance of a heat transfer area and washing of a heat transfer surface, as well as evaporation of the liquid is simplified.

What is claimed is:

1. A liquid ejection apparatus for maintaining a beat-transfer area of said liquid and for cleaning an inner surface of a container of said liquid and for cleaning an outer surface of a heat transfer means:

wherein at least one gutter body is disposed in said container having said inner surface, said gutter body serving as a liquid transporting body and having a lower opening and an upper opening at respective lower and upper end portions thereof, said gutter body having a longitudinal recess along a portion thereof and being secured to an agitator shaft by attachment means, said longitudinal recess facing towards said agitator shaft, said gutter body having an inclination angle provided by said attachment means and being greater than 0° and up to 90° with respect to a plane perpendicular to said agitator shaft, said gutter body being oriented at an eccentric or deviation angle greater than 0°, and said gutter body being revolvable around a center of said agitator shaft with said recess in said gutter body facing said agitator shaft, and said lower opening of said gutter body being immersed beneath a liquid surface, and said upper opening of said gutter body being exposed from said liquid surface, so that liquid at an immersed portion of said gutter body passes within said gutter body and is ejected from said upper opening above said liquid surface and onto said inner surface so as to allow heat transfer between said liquid and said heat transfer means and wherein said eccentric or deviation angle is the angle between a first plane containing a rotation plane radius extending from said agitator shaft to a center point on said gutter body and a second plane containing a center line extending from said center point of said gutter body and dividing in two an opening border of said gutter body.

2. The liquid ejection apparatus according to claim 1, wherein said gutter body has a coating or a lining.

3. The liquid ejection apparatus according to claim 1, wherein said upper opening of said gutter body is covered by a cover which is removable and is selected from the group consisting of perforated plates and meshes.

4. The liquid ejection apparatus according to claim 1, wherein said upper opening of said gutter body is closed by a plate such that a gap is formed along an inner peripheral surface of said gutter body.

5. The liquid ejection apparatus according to claim 1, wherein a deflector plate is provided and is spaced apart from said upper opening of said gutter body.

6. The liquid ejection apparatus according to claim 1, wherein said gutter body is bendable.

7. The liquid ejection apparatus of claim 1, wherein said gutter body is substantially straight along said inclination angle.

8. The liquid ejection apparatus of claim 1, wherein said liquid ejection apparatus comprises at least two gutter bodies mounted on opposite sides of said agitator shaft by two respective attachment devices and wherein said two gutter bodies are located on different sides of a plane extending through said agitator shaft and said two respective attachment devices.

9. The liquid ejection apparatus of claim 1, wherein said gutter body has a non-symmetrical shape.

10. A liquid ejection apparatus for maintaining a heat-transfer area of said liquid and for cleaning an inner surface of a container of said liquid and for cleaning an outer surface of a heat transfer means:

wherein at least one gutter body is disposed in said container having said inner surface, said gutter body serving as a liquid transporting body and having a lower opening and an upper opening at respective lower and upper end portions thereof is mounted on an agitator shaft by attachment means and having a longitudinal recess, said gutter body having an inclination angle which is adjustable by said attachment means to be greater than 0° and up to 90° with respect to a plane perpendicular to said agitator shaft, said gutter body being oriented at an eccentric or deviation angle greater than 0°, and said gutter body being revolved around said agitator shaft with said longitudinal recess disposed in said gutter body facing said agitator shaft, and said lower opening of said gutter body being immersed beneath a liquid surface, and said upper opening of said gutter body being exposed from said liquid surface, so that liquid at an immersed portion of said gutter body passes within said gutter body and is ejected from said upper opening above said liquid surface and onto said inner surface so as to allow heat transfer between said liquid and said beat transfer means; and wherein said eccentric or deviation angle is the angle between a first plane containing a rotation plane radius extending from said agitator shaft to a center point on said gutter body and a second plane containing a center line extending from said center point of said gutter body and dividing in two an opening border of said gutter body.

11. The liquid ejection apparatus according to claim 10, wherein said attachment means is mounted so as to be slidable on said agitator shaft.

12. The liquid ejection apparatus according to claim 10, wherein said gutter body has a coating or a lining.

13. The liquid ejection apparatus according to claim 10, wherein said upper opening of said gutter body is covered by a cover selected from the group consisting of perforated plates and meshes.

14. The liquid ejection apparatus according to claim 10, wherein said upper opening of said gutter body is closed by a plate such that a gap is formed along an inner peripheral surface of said gutter body.

15. The liquid ejection apparatus according to claim 10, wherein a deflector plate is provided and is spaced apart from said upper opening of said gutter body.

16. The liquid ejection apparatus according to claim 10, wherein said gutter body is bendable.

17. The liquid ejection apparatus according to claim 10, wherein a longitudinal opening of said gutter body is covered by a removable cover.

18. The liquid ejection apparatus of claim 10, wherein said gutter body is substantially straight along said inclination angle.

19. The liquid ejection apparatus of claim 10, wherein said liquid ejection apparatus comprises at least two gutter bodies mounted on opposite sides of said agitator shaft by two respective attachment devices and wherein said two gutter bodies are located on different sides of a plane extending through said agitator shaft and said two respective attachment devices.

20. The liquid ejection apparatus of claim 10, wherein said gutter body has a non-symmetrical shape.

21. A method of ejecting a liquid for maintaining a heat-transfer area of said liquid and for cleaning an inner surface of a container of said liquid and for cleaning an outer surface of a beat transfer means, said method involving revolving a liquid transporting body of a liquid ejection apparatus, around an agitator shaft with a lower opening immersed beneath a liquid surface, and an upper opening exposed from said liquid surface, so that said liquid at the immersed portion of said liquid transporting body passes within said liquid transporting body and is ejected from said upper opening of said liquid transporting body; said liquid ejection apparatus comprising:

at least one gutter body disposed in said container having said inner surface, said gutter body serving as said liquid transporting body and having said lower opening and an upper opening at respective lower and upper end portions thereof, said gutter body having a longitudinal recess along an portion thereof and being mounted on said agitator shaft by attachment means, said longitudinal recess facing towards said agitator shaft, said gutter body having inclination angle which is adjustable by said attachment means to be greater than 0 ° and up to 90° with respect to a plane perpendicular with said agitator shaft, said gutter body being oriented at an eccentric or deviation angle greater than 0°, and said gutter body being revolved around said agitator shaft with said longitudinal recess disposed in said gutter body and facing said agitator shaft, and said lower opening of said gutter body being immersed beneath said liquid surface, and said upper opening of said gutter body being exposed from said liquid surface, so that liquid at said immersed portion of said gutter body passes within said gutter body and is ejected from said upper opening above said liquid surface and onto said inner surface so as to allow heat transfer between said liquid and said heat transfer means wherein said eccentric or deviation angle is the angle between a first plane containing a rotation plane radius extending from said agitator shaft to a center point on said gutter body and a second plane containing a center line extending from said center point of said gutter body and dividing in two an opening border of said gutter body.

22. The method of claim 21 wherein the liquid ejected from the upper opening of said liquid transporting body is distributed onto an inner peripheral surface of a container wall to thereby wash the inner peripheral surface of the container wall.

23. The method of claim 21 wherein the liquid ejected from the upper opening of said liquid transporting body is distributed onto a heat transfer surface to thereby maintain the heat transfer area and/or wash the heat transfer surface.

24. The method of claim 21 wherein the liquid ejected from the upper opening of said liquid transporting body is distributed into the space above the liquid surface to thereby cause evaporation.

25. The method of claim 21, wherein said gutter body is substantially straight along said inclination angle.

26. The method of claim 21, wherein said liquid ejection apparatus comprises at least two gutter bodies mounted on opposite sides of said agitator shaft by two respective attachment devices and wherein said two gutter bodies are located on different sides of a plane extending through said agitator shaft and said two respective attachment devices.

27. The method of claim 21, wherein said gutter body has a non-symmetrical shape.

28. A liquid ejection apparatus for maintaining a heat-transfer area of said liquid and for cleaning an inner surface of a container of said liquid and for cleaning an outer surface of a heat transfer means:

wherein at least one gutter body is disposed in said container having said inner surface, said gutter body serving as a liquid transporting body and having a lower opening and an upper opening at respective lower and upper end portions thereof, said gutter body having a longitudinal recess along a portion thereof and being secured to an agitator shaft by attachment means, said longitudinal recess facing towards said agitator shaft, said gutter body having an inclination angle provided by said attachment means and being greater than 0° and up to 90° with respect to a plane perpendicular to said agitator shaft, and said gutter body being revolvable around a center of said agitator shaft with said recess in said gutter body facing said agitator shaft, and said lower opening of said gutter body being immersed beneath a liquid surface, and said upper opening of said gutter body being exposed from said liquid surface, so that liquid at an immersed portion of said gutter body passes within said gutter body and is ejected from said upper opening above said liquid surface and onto said inner surface so as to allow heat transfer between said liquid and said heat transfer means, and wherein said liquid ejection apparatus includes a means for orienting said gutter body to an eccentric or deviation angle greater than 0°, said eccentric or deviation angle being the angle between a first plane containing a rotation plane radius extending from said agitator shaft to a center point on said gutter body and a second plane containing a center line extending from said center point of said gutter body and dividing in two an opening border of said gutter body.

29. The liquid ejection apparatus of claim 28, wherein said gutter body is substantially straight along said inclination angle.

30. The liquid ejection apparatus of claim 28 wherein said liquid ejection apparatus comprises at least two gutter bodies mounted on opposite sides of said agitator shaft by two respective attachment devices and wherein said two gutter bodies are located on different sides of a plane extending through said agitator shaft and said two respective attachment devices.

31. The liquid ejection apparatus of claim 28, wherein said gutter body has a non-symmetrical shape.

32. A liquid ejection apparatus for maintaining a heat-transfer area of said liquid and for cleaning an inner surface of a container of said liquid and for cleaning an outer surface of a heat transfer means:

wherein at least one gutter body is disposed in said container having said inner surface, said gutter body serving as a liquid transporting body and having a lower opening and an upper opening at respective lower and upper end portions thereof is mounted on an agitator shaft by attachment means and having a longitudinal recess, said gutter body having an inclination angle which is adjustable by said attachment means to be greater than 0° and up to 90° with respect to a plane perpendicular to said agitator shaft, and said gutter body being revolved around said agitator shaft with said longitudinal recess disposed in said gutter body and facing said agitator shaft, and said lower opening of said gutter body being immersed beneath a liquid surface, and said upper opening of said gutter body being exposed from said liquid surface, so that liquid at an immersed portion of said gutter body passes within said gutter body and is ejected from said upper opening above said liquid surface and onto said inner surface so as to allow heat transfer between said liquid and said heat transfer means, and wherein said liquid ejection apparatus includes a means for orienting said gutter body to an eccentric or deviation angle greater than 0°, said eccentric or deviation angle being the angle between a first plane containing a rotation plane radius extending from said agitator shaft to a center point on said gutter body and a second plane containing a center line extending from said center point of said gutter body and dividing in two an opening border of said gutter body.

33. The liquid ejection apparatus of claim 32, wherein said gutter body is substantially straight along said inclination angle.

34. The liquid ejection apparatus of claim 32, wherein said liquid ejection apparatus comprises at least two gutter bodies mounted on opposite sides of said agitator shaft by two respective attachment devices and wherein said two gutter bodies are located on different sides of a plane extending through said agitator shaft and said two respective attachment devices.

35. The liquid ejection apparatus of claim 32, wherein said gutter body has a non-symmetrical shape.

36. A method of ejecting a liquid for maintaining a heat-transfer area of said liquid and for cleaning an inner surface of a container of said liquid and for cleaning an outer surface of a heat transfer means, said method involving revolving a liquid transporting body of a liquid ejection apparatus, around an agitator shaft with a lower opening immersed beneath a liquid surface, and an upper opening exposed from said liquid surface, so that said liquid at the immersed portion of said liquid transporting body passes within said liquid transporting body and is ejected from said upper opening of said liquid transporting body; said liquid ejection apparatus comprising:

at least one gutter body disposed in said container having said inner surface, said gutter body serving as said liquid transporting body and having said lower opening and an upper opening at respective lower and upper end portions thereof, said gutter body having a longitudinal recess along an portion thereof and being mounted on said agitator shaft by attachment means, said longitudinal recess facing towards said agitator shaft, said gutter body having inclination angle which is adjustable by said attachment means to be greater than 0° and up to 90° with respect to a plane perpendicular with said agitator shaft, and said gutter body being revolved around said agitator shaft with said longitudinal recess disposed in said gutter body and facing said agitator shaft, and said lower opening of said gutter body being immersed beneath said liquid surface, and said upper opening of said gutter body being exposed from said liquid surface, so that liquid at said immersed portion of said gutter body passes within said gutter body and is ejected from said upper opening above said liquid surface and onto said inner surface so as to allow heat transfer between said liquid and said heat transfer means, and wherein said liquid ejection apparatus includes a means for orienting said gutter body to an eccentric or deviation angle greater than 0°, said eccentric or deviation angle being the angle between a first plane containing a rotation plane radius extending from said agitator shaft to a center point on said gutter body and a second plane containing a center line extending from said center point of said gutter body and dividing in two an opening border of said gutter body.

37. The method of claim 36, wherein said gutter body is substantially straight along said inclination angle.

38. The method of claim 36, wherein said liquid ejection apparatus comprises at least two gutter bodies mounted on opposite sides of said agitator shaft by two respective attachment devices and wherein said two gutter bodies are located on different sides of a plane extending through said agitator shaft and said two respective attachment devices.

39. The method of claim 36, wherein said gutter body has a non-symmetrical shape.

* * * * *